US011976481B2

(12) United States Patent
Buenemann

(10) Patent No.: US 11,976,481 B2
(45) Date of Patent: May 7, 2024

(54) SAFETY RAIL SYSTEM

(71) Applicant: ALDECK GROUP PTY LTD, Thomastown (AU)

(72) Inventor: Anton Buenemann, Eltham (AU)

(73) Assignee: ALDECK GROUP PTY LTD, Thomastown (AU)

( * ) Notice: Subject to any disclaimer, the term of this patent is extended or adjusted under 35 U.S.C. 154(b) by 1512 days.

(21) Appl. No.: 16/067,935

(22) PCT Filed: Sep. 14, 2017

(86) PCT No.: PCT/AU2017/051002

§ 371 (c)(1),
(2) Date: Jul. 3, 2018

(87) PCT Pub. No.: WO2018/049477

PCT Pub. Date: Mar. 22, 2018

(65) Prior Publication Data

US 2020/0270882 A1 Aug. 27, 2020

(30) Foreign Application Priority Data

Sep. 16, 2016 (AU) ..... 2016903731
Jun. 19, 2017 (AU) ..... 2017902334
(Continued)

(51) Int. Cl.
*E04G 21/32* (2006.01)
*E04G 5/14* (2006.01)
*E04G 7/14* (2006.01)

(52) U.S. Cl.
CPC ..... *E04G 21/3295* (2013.01); *E04G 5/142* (2013.01); *E04G 7/14* (2013.01);
(Continued)

(58) Field of Classification Search
CPC ..... E04G 21/3295; E04G 21/3233; E04G 21/3266; E04G 21/3276; E04G 21/3223;
(Continued)

(56) References Cited

U.S. PATENT DOCUMENTS 2,329,415 A * 9/1943 Osborne ..... E04G 5/041 248/237
3,589,682 A * 6/1971 Dickey ..... E04G 21/3233 256/65.1
(Continued)

FOREIGN PATENT DOCUMENTS

CN 105587132 A 5/2016
CN 106854938 A 6/2017
(Continued)

OTHER PUBLICATIONS

<URL: http://www.ecaccesssolutions.com/ecas/forms/frmStockInfo_12.aspx>published on Sep. 23, 2009 as per 1 Wayback Machine **** Claims: 1-4.

*Primary Examiner* — Daniel P Cahn
*Assistant Examiner* — Shiref M Mekhaeil
(74) *Attorney, Agent, or Firm* — Nadya Reingand

(57) ABSTRACT

A safety rail apparatus is provided, which comprises a post with a base configured to reversibly engage with a floor and providing support for at least 12 kN load, a rail holder configured to hold a rail in reversibly fixed engagement with the post and a plurality of components which are together operable to adjust the height of the post between a lower height of 900 mm-1.2 m and an upper height of 1.9 m-2.5 m. The plurality of compontents is further configured to adjust the height of the post to the lower height during one stage of a construction project and to the upper height during another stage of the construction project such that the upper height is at least 1.8 times higher than the lower height. The
(Continued)

apparatus further comprises a mesh support configured to reversibly engage with the rail and support a mesh.

7 Claims, 33 Drawing Sheets

(30) Foreign Application Priority Data

Aug. 11, 2017 (AU) ..... 2017903215
Sep. 7, 2017 (AU) ..... 2017903629

(52) U.S. Cl.
CPC ..... *E04G 21/3233* (2013.01); *E04G 21/3266* (2013.01); *E04G 21/3276* (2013.01); *E04G 5/145* (2013.01)

(58) Field of Classification Search
CPC E04G 5/142; E04G 5/145; E04G 7/14; E04H 17/146; E04H 17/1465; E04H 17/22
See application file for complete search history.

(56) References Cited

U.S. PATENT DOCUMENTS 3,867,997 A * 2/1975 Hyslop, Jr. ..... E04G 5/14 256/65.05
3,949,834 A * 4/1976 Nusbaum ..... E04G 21/3266 182/138
3,995,833 A * 12/1976 McLaughlin et al. ..... E04G 21/3242 256/65.14
4,074,791 A * 2/1978 Inman ..... A62B 1/22 182/138
4,078,633 A * 3/1978 Fahy ..... E04G 3/265 182/229
4,598,794 A * 7/1986 Anderson ..... E04G 7/28 182/132
4,666,131 A * 5/1987 Kettelkamp, Sr. ..... E04G 5/041 182/113
4,691,485 A * 9/1987 Nagy ..... E04B 1/3516 52/125.1
4,732,234 A * 3/1988 Brickman ..... E04G 21/3266 182/138
4,815,562 A * 3/1989 Denny ..... E04G 21/24 182/138
4,838,382 A * 6/1989 Nusbaum ..... E04G 21/3261 182/138
4,856,615 A * 8/1989 Nusbaum ..... E04G 21/3266 182/138
4,892,169 A * 1/1990 Duncan ..... E04G 21/3261 182/138
5,012,627 A * 5/1991 Lundmark ..... E04G 11/20 52/745.04
5,161,641 A * 11/1992 Nusbaum ..... E04G 21/3223 182/138
D373,718 S * 9/1996 Rondeau ..... D8/349
5,573,227 A * 11/1996 Hemauer ..... E04G 21/3214 256/65.06
5,582,266 A * 12/1996 Rexroad ..... E04G 21/3266 182/138
5,638,917 A * 6/1997 Vennen ..... E04G 3/20 182/113
5,647,451 A * 7/1997 Reichel ..... E04G 5/041 182/113
5,718,305 A * 2/1998 Palmer ..... E04G 21/3261 182/45
5,829,549 A * 11/1998 Flynn ..... E04G 5/06 182/150
5,884,725 A * 3/1999 Reyland ..... E04G 1/20 182/136
6,003,631 A * 12/1999 Knauth ..... E04G 3/20 182/150
6,015,028 A * 1/2000 Smith ..... E04G 1/20 182/136
6,021,702 A * 2/2000 Rexroad ..... E04G 21/24 87/13
6,038,829 A * 3/2000 Franks ..... E04G 21/3242 52/645
6,039,150 A * 3/2000 Palmer ..... E04G 21/3223 182/113
6,336,623 B1 * 1/2002 McCarthy ..... E04G 21/3214 256/64
6,679,482 B2 * 1/2004 Allenbaugh ..... E04G 21/3242 248/231.71
6,722,468 B2 * 4/2004 Albano ..... E04G 3/20 182/150
6,842,992 B1 * 1/2005 Gitt ..... E04G 21/1825 33/1 LE
8,132,792 B2 * 3/2012 Perris ..... E04G 21/3223 182/113
8,448,923 B1 * 5/2013 Schad ..... E04G 21/3219 256/65.03
9,145,694 B2 * 9/2015 Bulley ..... E04G 5/048
9,731,640 B1 * 8/2017 Meacham ..... B60R 3/005
10,689,866 B2 * 6/2020 Baca ..... E04G 5/14
10,982,454 B2 * 4/2021 Melic ..... E04G 21/3223
11,236,511 B2 * 2/2022 Henderson ..... E04H 17/20
2002/0139614 A1 * 10/2002 Volkman ..... E04G 3/26 182/150
2003/0132427 A1 * 7/2003 Allenbaugh ..... E04G 21/3233 256/65.14
2006/0090961 A1 * 5/2006 Rexroad ..... A62B 1/22 182/138
2007/0246299 A1 * 10/2007 Wright ..... E04G 21/3242 182/113
2007/0252055 A1 * 11/2007 Melic ..... E04G 21/3233 248/200.1
2009/0152048 A1 * 6/2009 Rooney ..... E04G 5/001 29/428
2009/0159865 A1 * 6/2009 Carvalho ..... E04G 21/3223 256/65.14
2011/0272659 A1 * 11/2011 Gutierrez ..... E04G 21/3204 256/68
2011/0278526 A1 * 11/2011 Carvalho ..... E04G 21/3219 256/65.03
2014/0263904 A1 * 9/2014 Kozyra ..... E02D 29/02 248/231.71
2015/0225912 A1 * 8/2015 Nunes ..... A63K 1/00 29/525.01
2015/0225919 A1 * 8/2015 Wagler ..... E04H 12/2253 52/166
2016/0192989 A1 * 7/2016 Aman ..... A61B 50/22 606/53
2016/0305152 A1 * 10/2016 Kozyra ..... E01F 15/0461
2018/0127993 A1 * 5/2018 Baca ..... E04G 5/14
2018/0347219 A1 * 12/2018 Cockerell ..... E04G 21/3266
2021/0238872 A1 * 8/2021 Brim, III ..... E04G 21/3223

FOREIGN PATENT DOCUMENTS

| | | | |
|---|---|---|---|
| CN | 206346509 | U | 7/2017 |
| EP | 1482104 | A1 | 12/2002 |
| EP | 2378032 | A1 | 10/2011 |
| GB | 1260565 | A | 1/1972 |
| GB | 2468688 | A | 9/2010 |
| GB | 2483106 | A | 2/2012 |
| JP | S50-000902 | | 1/1975 |
| JP | S59-177478 | | 10/1984 |
| JP | S58-247926 | | 10/1985 |
| JP | H4-46025 | | 10/1992 |
| JP | H06-028089 | | 4/1994 |
| JP | H07-127240 | | 5/1995 |
| JP | H11-256835 | | 11/1999 |
| JP | 2014-101642 | | 6/2014 |
| KR | 101472962 | B1 | 12/2014 |
| WO | 1993020311 | | 10/1993 |
| WO | 2011082927 | | 7/2011 |
| WO | 2011095288 | | 8/2011 |
| WO | 2011095289 | | 8/2011 |

(56) References Cited

FOREIGN PATENT DOCUMENTS

| | | |
|---|---|---|
| WO | 2012000591 | 1/2012 |
| WO | 2014171536 | 10/2014 |
| WO | 201608215 | 1/2016 |
| WO | 2017174808 | 10/2017 |

* cited by examiner

SAFETY RAIL SYSTEM

CROSS-REFERENCE TO RELATED APPLICATIONS

The present patent application is a National stage application of the PCT application PCT/AU2017/051002 filed Sep. 14, 2017, which claims priority to the following Australian Patent Applications AU 2016903731 filed Sep. 16, 2016, AU 2017902334 filed Jun. 19, 2017, AU 2017903215 filed Aug. 11, 2017 and AU 2017903629 filed Sep. 7, 2017.

BACKGROUND OF THE INVENTION

Construction work is dangerous. Falls from heights (either of people or materials that fall onto people) are reported by some sources to be the leading cause of injury in the construction industry. Fall protection is needed in areas such as ramps, walkways; excavations; hoist areas; holes; formwork; leading edge work; unprotected sides and edges; roofing; precast erection; wall openings; residential construction; industrial, commercial and high rise developments . Most countries have regulations and guidelines for fall protection to prevent injuries and deaths.

One safety measure to reduce hazards associated with falls from heights is the use of guard rails, also known as safety rails. Present day safety rails comprise a series of horizontal rails attached to posts that attach firmly to the building in regular intervals under construction. Posts come in a number of standard sizes, including 1.1 m, 1.5 m and 2 m in height.

Construction workers often require different barrier heights at different stages of a construction project. In certain stages of a development a builder may only wish to have safety perimeter railing at a lower height of 1.1 m. For example, at an early stage this allows the window installers that are required on site to take perimeter windows or facade out of the side of the building. Higher guardrails make this activity substantially more difficult and cumbersome. In later stages of the development, different trades, such as plumbers and plasterers and electricians need to work on short access ladders at approximately 1 m high and, close to the perimeter of the building. For this type of work, the trades people are vulnerable to potentially falling off these access ladders and over the 1.1 m high handrail and consequently over the edge of the building. Therefore a higher handrail system of 1.5 m to 2.4 is required.

Unfortunately, however, current handrail systems don't quickly and cost effectively transform from one height to another.

In other situations, a company may have a stock of different height guard rails for use on various construction projects and it would be advantageous to be able to carry a single set of guard rails for deployment on any job and which can be adjusted to suit the height requirements of that individual job or that stage of construction.

The reference to any prior art in this specification is not, and should not be taken as, an acknowledgement or any form of suggestion that the prior art forms part of the common general knowledge.

SUMMARY OF THE INVENTION

Accordingly, the invention provides a post for a temporary safety rail system comprising a base for reversible engagement with a floor, a rail holder to hold a rail in reversibly fixed engagement with the post and a plurality of components which are together operable to adjust the height of the post. The post may preferably comprise a first component and a second component wherein the components are slidable about one another to adjust the height. In some embodiments, the second component is concentrically slidable within the first component and in some embodiments, the components are telescopic to adjust the height.

In some embodiments, the rail holder comprises one or more of: a clamp, an aperture, a slot, a bracket, a screw, a bolt, a wing nut. The rail holder may also for example comprise an internal aperture defined in the post and it may define an aperture to receive a rail and a clamp to reversibly fix the rail in secure engagement with the post. Some preferred embodiments comprise a plurality of rail holders which are optionally sited in vertical or horizontal series.

It has been found that preferably the apparatus of the invention comprises a stop to restrict downward movement of an upper post component relative to a lower post component. The stop may pass through an aperture defined by the lower post component and optionally under or through the upper post component.

The rail holder of the invention may optionally be integrally formed with the post or removable from the post.

The invention also provides a method of installing an adjustable height safety rail apparatus comprising a. placing a first base post at a desired location and fixing it to the underlying structure;
b. placing a second base post at a desired location and fixing it to the underlying structure;
c. installing one or more rails by placing them in contact with a rail holder associated with each of the first and second base posts and locking them in place;
d. attaching a kick board to at least one base post;
e. placing an extension post into each base post and locking them into place with a suitable locking device;
f. installing one or more rails into the extension posts, by placing them in contact with a rail holder associated with each of the first and second extension posts and locking them in place;
g. wherein, in steps a and b, one or more of the following fixtures are used:

for fixture to concrete: For posts 1.1 m high, minimum of 2×8 mm screw bolts per post, set as depicted in FIG. 18*i*; for posts greater than 1.1 m high, a minimum of 3×8 mm screw bolts per post, set as depicted in FIG. 18*j*; and for fixture to timber: For any height post, use a minimum of three 14×90 mm timber screws per post, set as depicted in FIG. 18*k*. Timber screws must go through plywood and into the timer support beams below.

The invention also provides a mesh support for a safety rail apparatus comprising a first component and a second component which are together operable to adjust the height of the support, a fixing means to reversibly fix the support at a selected height, a cross piece for supporting a mesh and a cross piece holder to hold a cross piece in reversibly fixed engagement with the mesh support. The support may comprise a first component and a second component wherein the components are slidable about one another to adjust the height which may for example be arranged so that the second component is concentrically slidable within the first component. The support may also comprise a first component and a second component wherein the components are telescopic to adjust the height.

In some embodiments, the cross piece holder comprises one or more of: a clamp, an aperture, a slot, a bracket, a screw, a bolt, a wing nut and in some, the cross piece holder defines an aperture to receive a rail and a clamp to reversibly fix the rail in secure engagement with the mesh support.

In some embodiments, the support comprises a stop to restrict downward movement of an upper post component relative to a lower post component. The stop may pass through an aperture defined by the lower post component and optionally under or through the upper post component.

In some preferred embodiments, the cross piece holder is optionally integrally formed with the post or removable from the post and in some, the cross piece is integrally formed with the post or removable from the post.

Some preferred embodiments of a support according to the invention comprise an outrigger element.

The invention also provides a safety post for providing a safety anchor point comprising a post according to claim 1 and a fixture to fix the base to a floor, wherein the post provides support for at least 12 kN load.

The invention also provides a post or stanchion for a construction safety rail system comprising a plurality of components which are together operable to enable the total height of the post to be adjusted. In another aspect of the invention there is provided a rail for a construction safety rail system as herein described.

Operability of the components may be by any suitable means. In some embodiments, of the invention there is provided a post for a construction safety rail system comprising a first component and a second component which are together operable to enable the total height of the post to be adjusted. Operability of the first and second components may be by any suitable means.

In some particularly preferred embodiments, at least one component is slidable within or along another. In some particularly preferred embodiments, one component is concentrically slidable within another. Such slidable engagement may for example be telescopic (for example, a telescopic staunchion). In some embodiments comprising slidable operability, there is provided a winding mechanism to wind one component relative to the other between heights. Such a winding mechanism must be sufficiently robust so as to meet the strength requirements of relevant safety standards. In some embodiments, the winding mechanism uses one or more gears to enable steady movement and preferably is lockable so as to set the height of the safety rail system at a wide variety of heights.

In some embodiments, the two components are hingedly connected and operability to adjust height is by moving one component relative to the other about the hinge mechanism.

In some embodiments, the two components are able to be reversibly engaged at different heights in a non-slidable manner. For example, one component may comprise one or more engagement points at which one or more corresponding engagement points along the second component may engage. An example of such an engagement mechanism is a key hole shaped slot through which a pin with a wide head is slotted.

Some embodiments may require that the first and second components are capable of fixed engagement (such as by locking) in position for operation. A fixing element of the invention such as this is referred to herein as a 'locking mechanism'. Such a locking mechanism may be required to ensure that the apparatus has sufficient strength to provide the intended safety benefit. For example, embodiments which use a slidable mechanism may comprise one or more pins or screws which pass at least partially through the body of each component when in position so as to 'lock' them in place at the selected position.

The invention also provides a rail engaging mechanism for a safety rail system comprising a component to engage with the substantially horizontal rails which form part of the overall system or apparatus. Such rails may engage with the rail engagement mechanism or indeed a post of the invention in any suitable manner and must be strong enough to comply with local safety and legal requirements. In some embodiments, the post comprises a mechanism to fix the rail in engagement (preferably reversibly) with the post. Some embodiments of this mechanism comprise a pin or screw member which may optionally press against the rail and therefore fix it in place, or pass at least partially through the rail to so fix it in place. Some embodiments may comprise an indentation in the surface of the rail to receive such a screw or pin member. Some embodiments further comprise a rest on which the rail rests or an aperture through which a rail may at least partially pass in order to provide further stability in fixing it relative to the post. Such an aperture may be of any suitable shape, in some embodiments it is generally rectangular, in others it is generally D shaped, it may also be any other suitable functional shape, such as circular, triangular, etc. The rail engagement system may be such that the rails are fixed in any suitable configuration, for example, in front of and behind one another or above and below each other, or they may abut one another, or for example adjacent rails may engage with each other so as to 'lock' together. Such engagement between adjacent rails may be of any suitable type, for example telescopic, pin, screws, bolts, cam device, and so on.

In some embodiments, the mechanism for fixing the rail in engagement with the post is able to be positioned at a plurality of positions along the post. In some embodiments, this mechanism is removable from the post member and can be placed at any required position. It may for example be slidably engageable with the post or a portion of it (for example an upper telescopic section) so as to enable a rail to be set at a plurality of heights. In some embodiments, one or more of these mechanisms is fixed whilst one or more of the others are moveable. For example, in some embodiments the top-most mechanism is fixed near the top of an adjustable section of a post, and additional mechanisms can be added as required. In such embodiments, only the top, fixed mechanism may be required when the post is at a low height (for example 1.1 m or 1.5 m) whereas additional mechanisms may be required for greater heights (such as 1.8 or 2 m or 2.4 m). In some embodiments, the mechanisms may remain attached to the post even when not in use so as to minimise additional items to be removed and stored or handled during the project. This embodiment also minimises the risk of lost components for the system.

In some embodiments, the safety rail post and system of the invention, easily transforms from a lower handrail, such as for example 900, 1 m or 1.1 m or 1.2 m high, that may be desirable at one stage of a project to a 1.5 m-2.5 m high (for example 1.5 or 1.6 or 1.7 or 1.8 or 1.9 or 2.0 or 2.1 or 2.2 or 2.3 or 2.4 or 2.5 m) handrail system that may for example be more desirable at a different stage of the project.

It should be noted that in some preferred embodiments, height adjustment can be done without the removal of the existing lower (for example 1.1 m high) safety rail already in place.

Therefore, the workers are not exposed to the additional risk of working for a period without a safety rail whilst they construct a higher safety rail.

Most posts according to the invention must be capable of solid, safe fixing to a solid structure in order to provide the stability required. This may be achieved in any suitable way.

A post according to the invention may also comprise a support member such as a base plate to provide support and a means of fixing the post at a location, for example to the floor or the ground. The support member may be of any suitable construction suitable to provide the strength required to maintain the post in an upright position and withstand loads as required by relevant safety standards. The base plate may also incorporate a means of allowing a kick plate or board to be attached as may be required by law in some locations.

In some embodiments, a post according to invention comprises a base which is capable of reversible fixing to a solid structure, such as the floor of a building under construction, or the ground, etc. The base may be fixed in any suitable manner. In some embodiments it is screwed or bolted to the solid structure, in others it may be clamped or a receiver or spigot cast into the floor or welded, for example.

In some embodiments, a support member or base according to the invention may comprise additional structural support such as a stub post or spigot welded to the structure that can engage with the post, for example a support defining a generally triangular shaped structure between a base plate and the post. In some embodiments such a support comprises a triangular stiffening wedge or an additional diagonal brace connecting reversibly to the side of the post and the floor.

The post and safety rail system of the invention reduces costs to a builder by reducing the need to purchase or hire posts of multiple heights, by reducing 'downtime' whilst rail posts are replaced to increase their height.

Throughout this specification (including any claims which follow), unless the context requires otherwise, the word 'comprise', and variations such as 'comprises' and 'comprising', will be understood to imply the inclusion of a stated integer or step or group of integers or steps but not the exclusion of any other integer or step or group of integers or steps.

DETAILED DESCRIPTION OF EXEMPLARY EMBODIMENTS

It is convenient to describe the invention herein in relation to particularly preferred embodiments. However, the invention is applicable to a wide range of embodiments and it is to be appreciated that other constructions and arrangements are also considered as falling within the scope of the invention. Various modifications, alterations, variations and or additions to the construction and arrangements described herein are also considered as falling within the ambit and scope of the present invention.

The various heights required during a construction project are readily accommodated by an apparatus of the invention. For example early on during a project, the workers may only require the safety rail to be at for example, 900 mm or 1 m or 1.1 m high. This allows the window or facade installers that are required on site to take perimeter windows or facade out of the side of the building. Higher guardrails make this activity substantially more difficult and cumbersome. In later stages of the development, different trades, such as plumbers, plasterers and electricians need to work on short access ladders or scissor lifts at approximately 1 m to 1.2 m high and, close to the perimeter of the building. For this type of work, the trades people are vulnerable to potentially falling off these access ladders and over the 1.1 m high handrail and consequently over the edge of the building. Therefore a higher handrail system of 1.5 m to 2.4 is required. Furthermore, a handrail system according to the invention can be readily lowered again later in a project when other trades or processes are required. The apparatus of the invention allows such modifications to readily occur without full replacement of the handrail system already in place, or without the need for numerous tools and without creating additional loose components (for example which have been removed) and which can get in the way and cause safety hazards.

Figure 1:
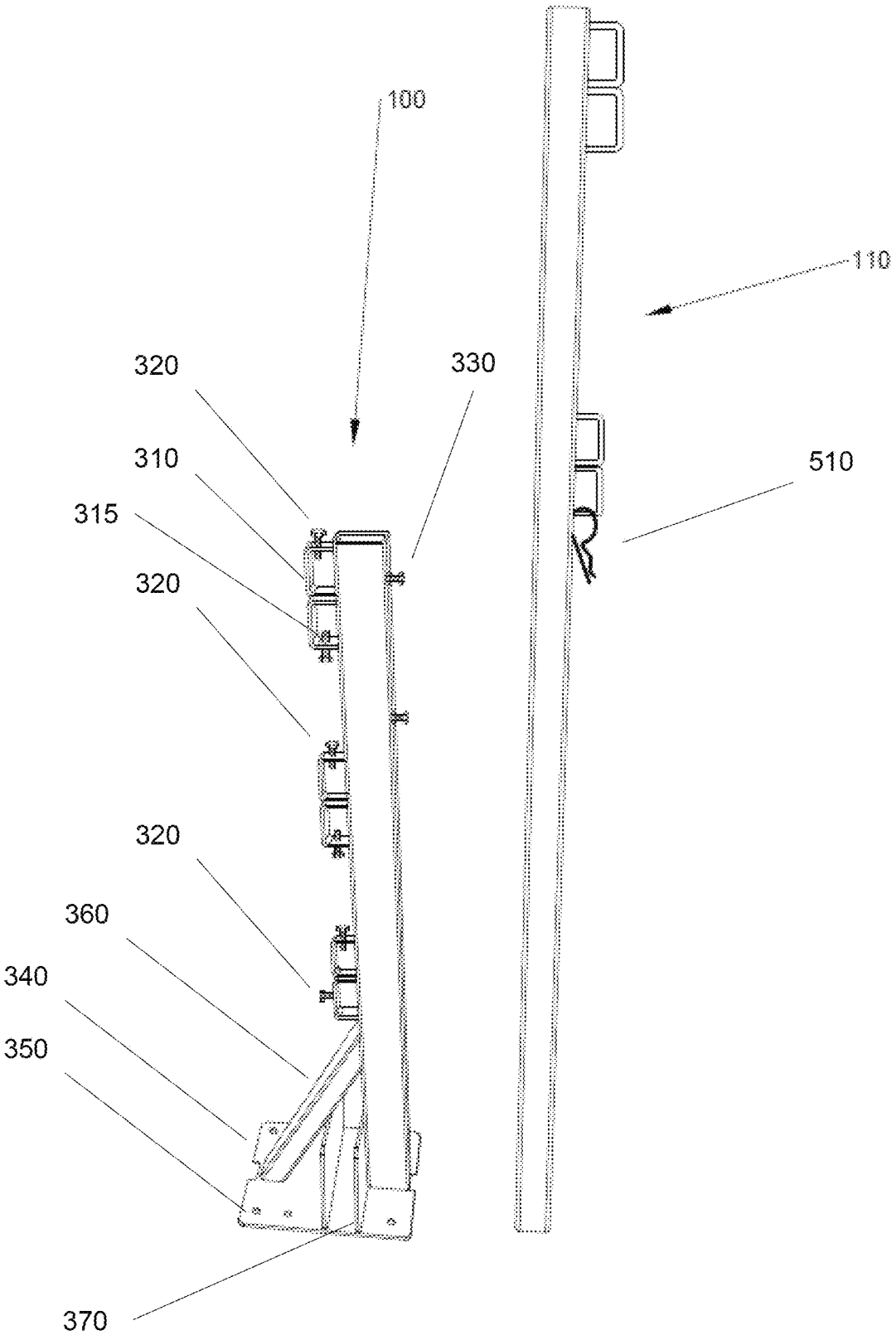
FIG. 1 is a side view of the first and second components according to one preferred embodiment of the invention.
Figure 19:
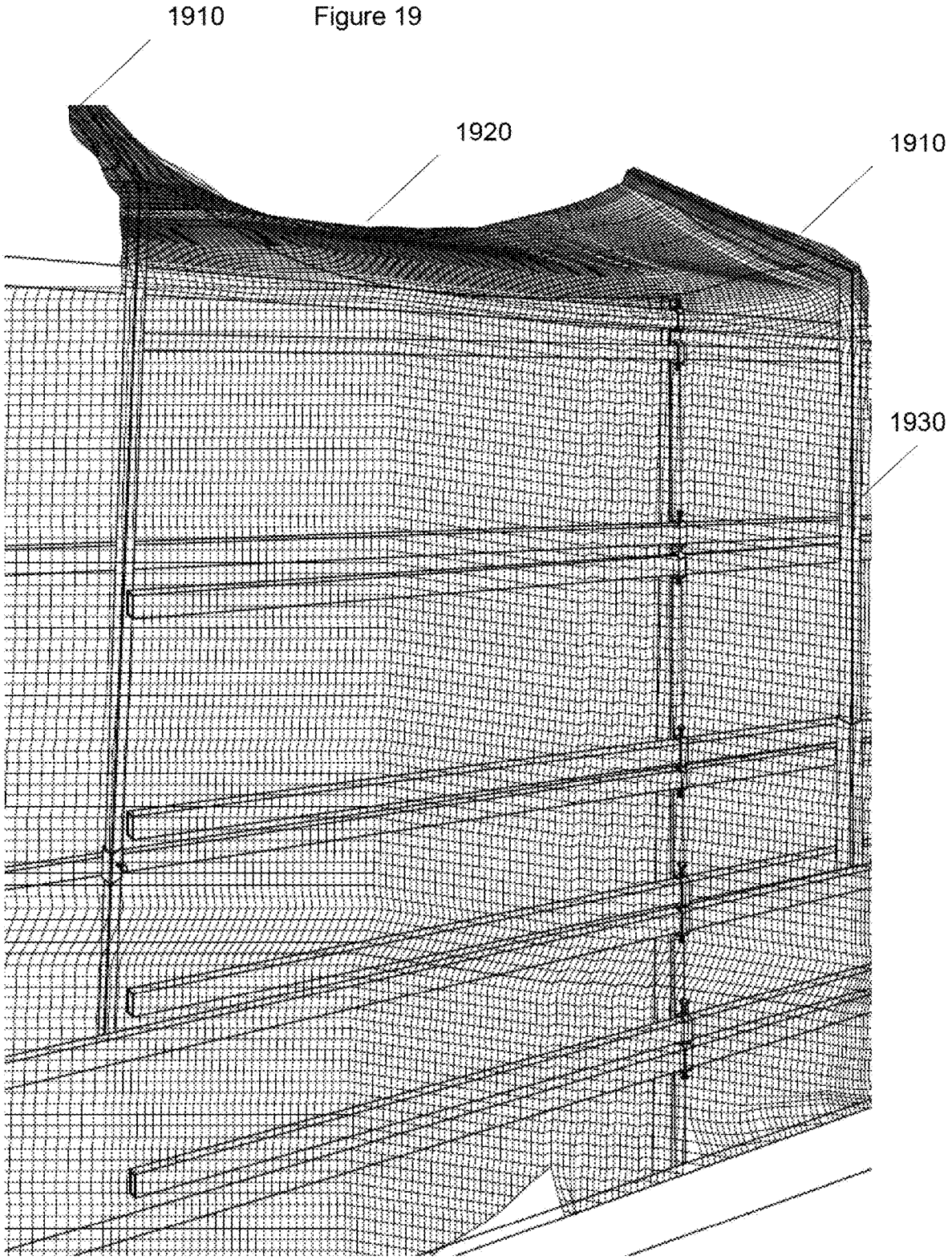
FIG. 19 depicts a safety post and rail system according to the invention comprising outrigger elements and protective netting.

FIG. 1 is a side view of an example first component (100) and second component (110) according to one preferred embodiment of the invention in which, in use, the second component is slidably engaged with the first component. In this embodiment, both components comprise posts or post members. The first component comprises apertures 310 to receive a rail and fixing means 320 (in this embodiment a bolt or screw) to reversibly fix a rail extending to an adjacent post therein. It can be seen that there is a second aperture 315 which is intended to receive a second rail which is intended to extend to a different post, on the other side of this post. In this way, rails can extend through each aperture which makes for a stronger attachment, but also greater control in varying the distances between posts for different applications. It will be appreciated, that as a result, in use the rails will overlap one another as depicted in FIG. 19. In this embodiment, the aperture member defines two adjacent apertures which together are directed along the axis of the post. In this embodiment, the rails overlap one another one above the other, but they may equally overlap horizontally or in other conformations or configurations. In some embodiments, the rails do not overlap. For example they may meet within the aperture member which defines the aperture, or they may be joined one to another lengthways, etc.

Item 330, which is the means of locking or fixing the first and second components (or posts) together is in this embodiment also a bolt or screw. In this embodiment, the safety post comprises base 340 with holes 350 for attachment to a flooring or the ground, and which has diagonal support 360 and horizontal supports 370 for support of a kick board 710 and for additional strength. FIG. 1 also depicts an additional safety device 510 which in this embodiment is in the form of a pin which is attached to the first component by a cord.

Figure 2:
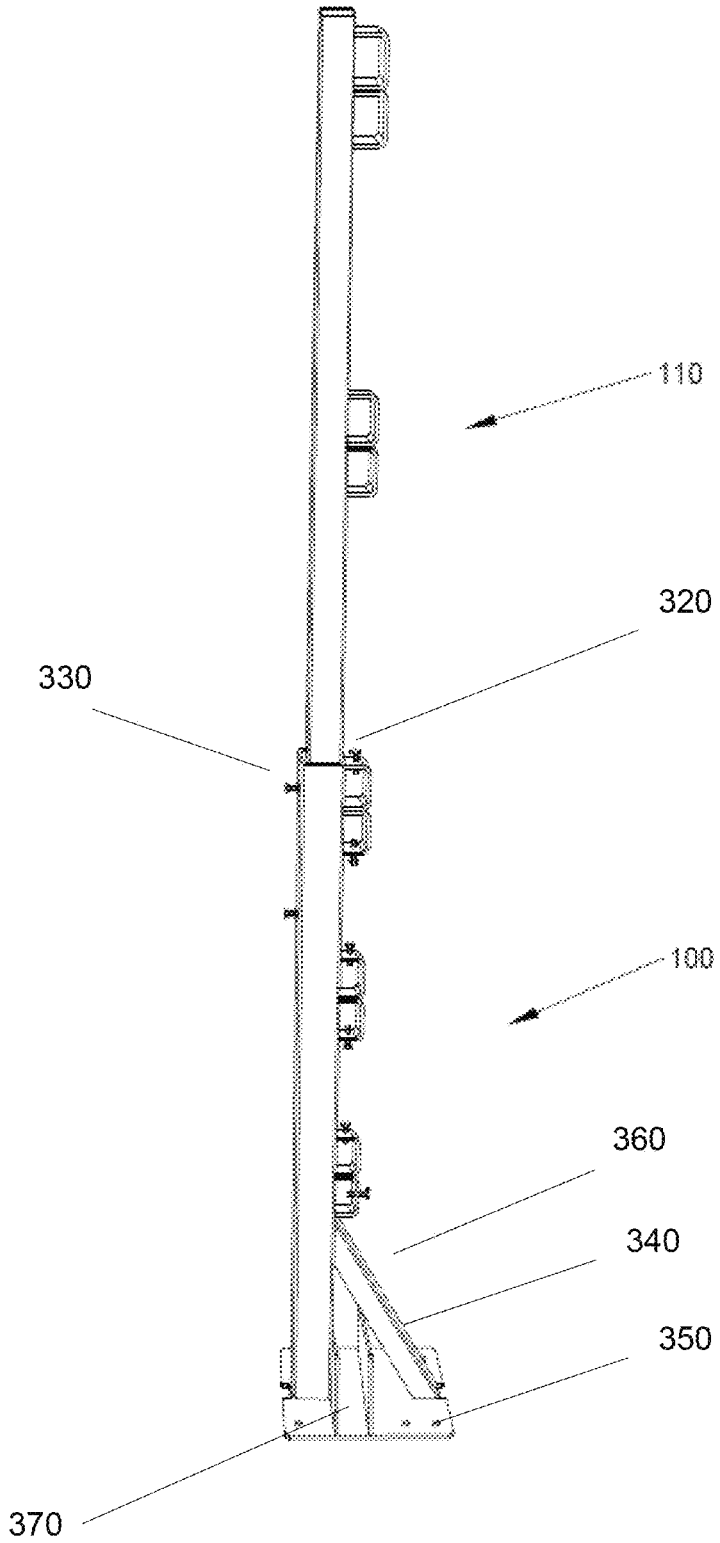
FIG. 2 is a side view of the embodiment of FIG. 1 with the first and second components engaged ready for use.

FIG. 2 depicts the same embodiment as FIG. 1, with the first and second components or posts slidably engaged and fixed at an extended position using locking mechanism 330 which in this embodiment comprises a pair of bolts which are tightened so as to press against the upper post or second component and thereby hold it in place.

Figure 3:
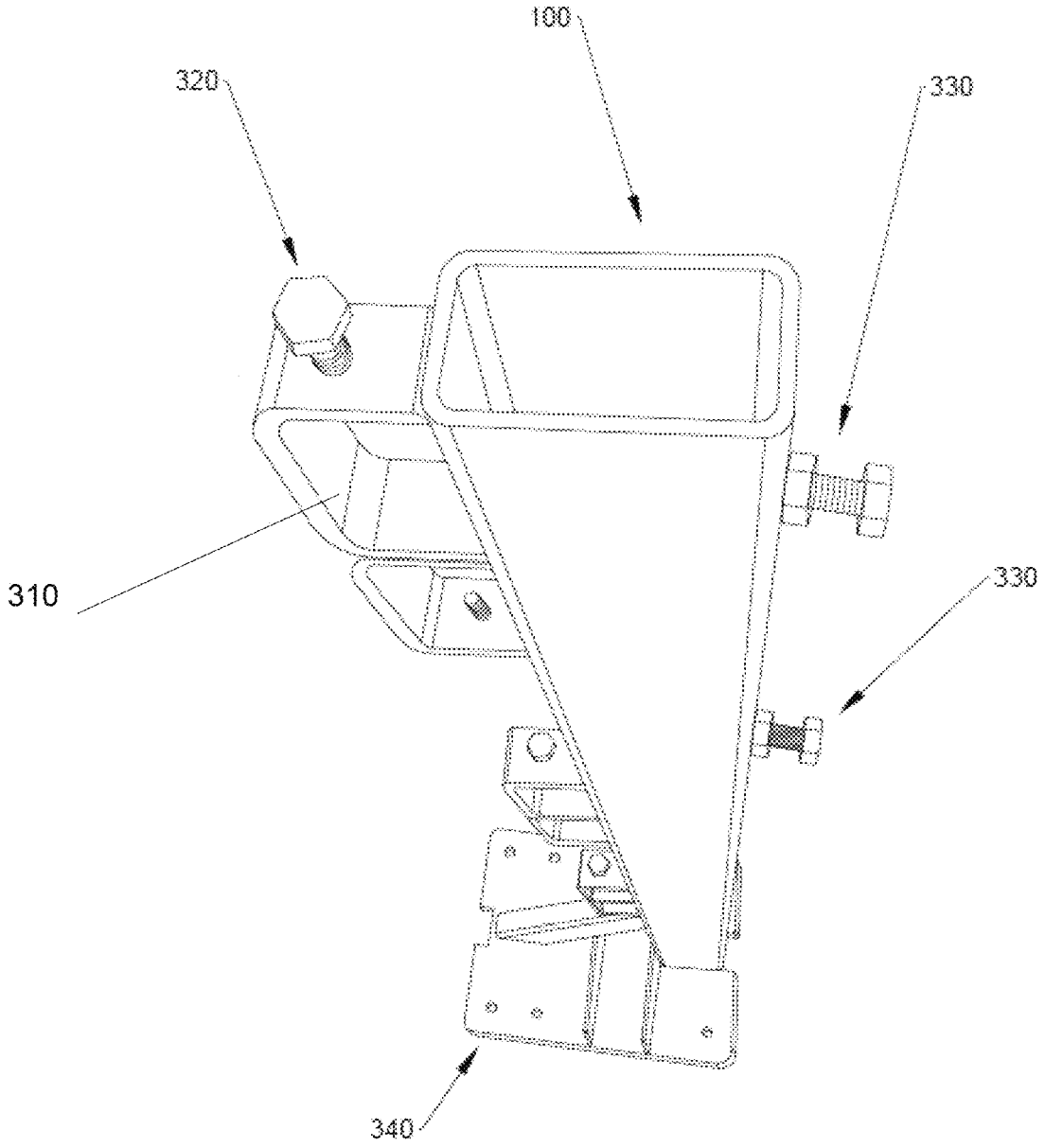
FIG. 3 is a top perspective view of the first component of the post according to FIG. 1.

FIG. 3 is a top perspective view of the first component or lower post of the safety post according to FIG. 1 shown generally at 100. Post component 100 comprises an aperture 310 to receive a rail and fixing means 320 which in this embodiment comprises a bolt which is tightened down against the rail so as to reversibly 'lock' it in place. Post component 100 also comprises base 340 and 'locking mechanism' 330 which is used to reversibly fix the first component to the second component at a selected height once the second component is slid within the body of the first component to the selected height.

Figure 4:
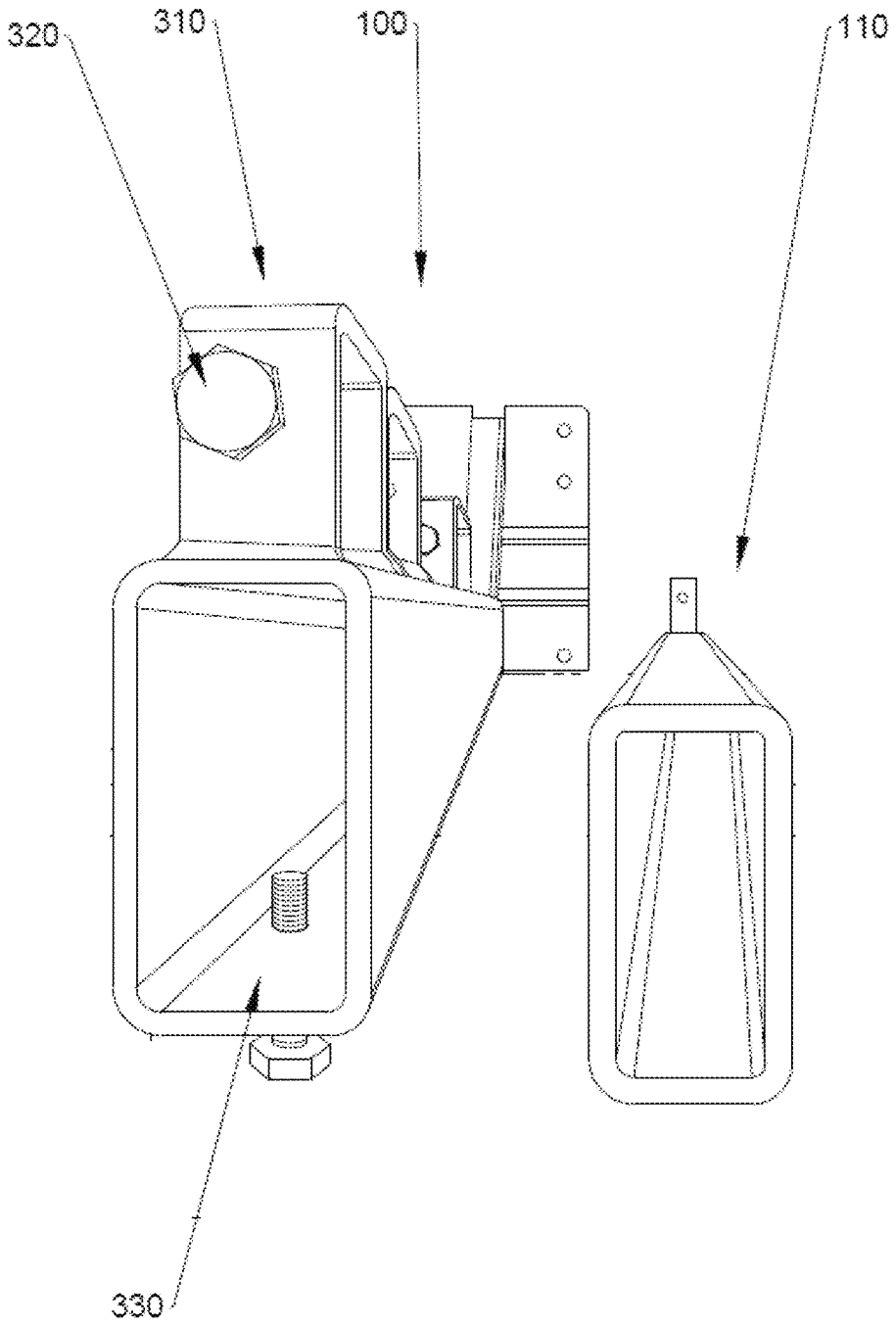
FIG. 4 is a top view of the first and second components from FIG. 1.

FIG. 4 is a top view of the first (100) and second (110) components from FIG. 1. This view also shows aperture 310, fixing means 320 and locking mechanism 330.

Figure 5:
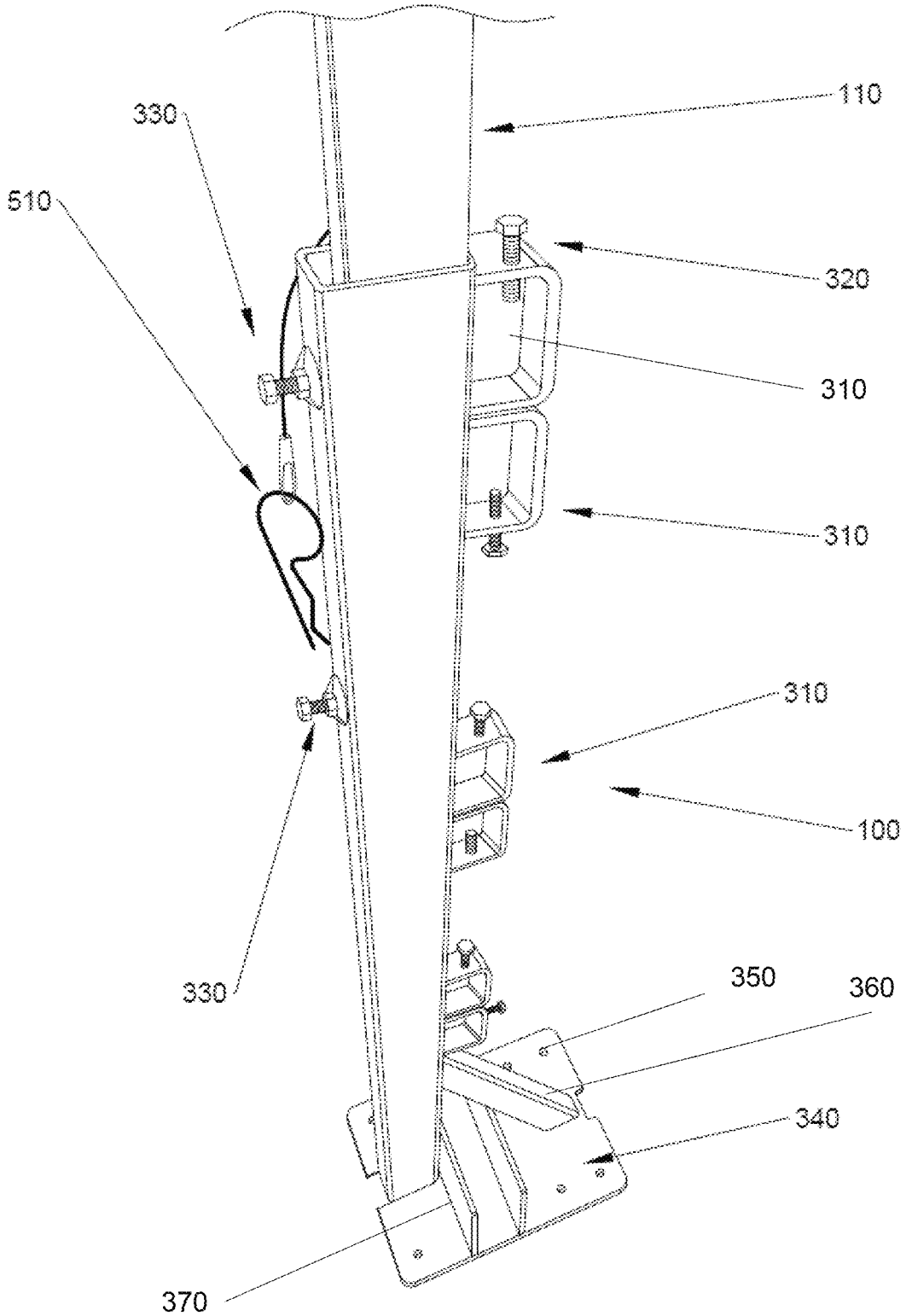
FIGS. 5 and 6 are further side perspective views of the embodiment of FIG. 1.
Figure 6:
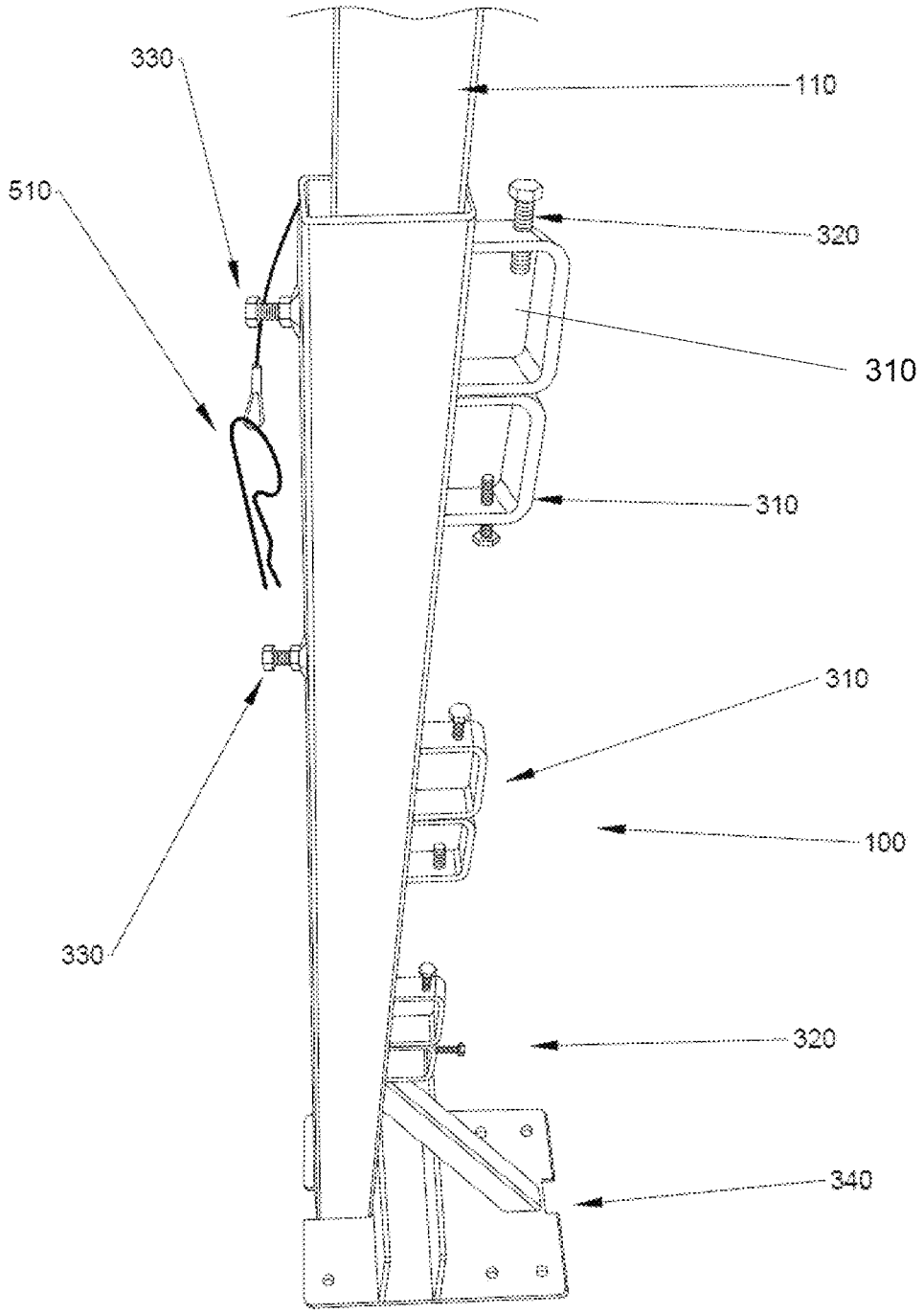

FIGS. 5 and 6 are further side views of the embodiment of FIG. 1. Again, these views depict aperture 310, fixing means 320 and locking mechanism 330 as well as base 340 with holes 350 for fixing to a floor and supports 360 and 370. FIGS. 5 and 6 also depict an additional safety device 510 which in this embodiment is in the form of a pin which is attached to the first component by a cord. This pin is used to provide a further, secure fixture between the first and second components by passing at least partially through each and thereby fixing them together. In this embodiment, pin 510 is particularly useful in providing additional safety in the event of a person or heavy weight falling on to the top rail from above. Thus, even if the impact of the weight or person is sufficient to push past the screws 330 which have been tightened so as to firmly hold the second component at a particular location, the pin cannot be so moved and will withstand such an impact and therefore stop the first component from collapsing into the second component or vis versa. An alternative to this is stop 1310 in FIG. 13 (in this embodiment safety device 510 is in the form of a bolt) which passes through the first component 100 and below the second component 110 thus preventing it from collapsing into the first component.

Figure 7:
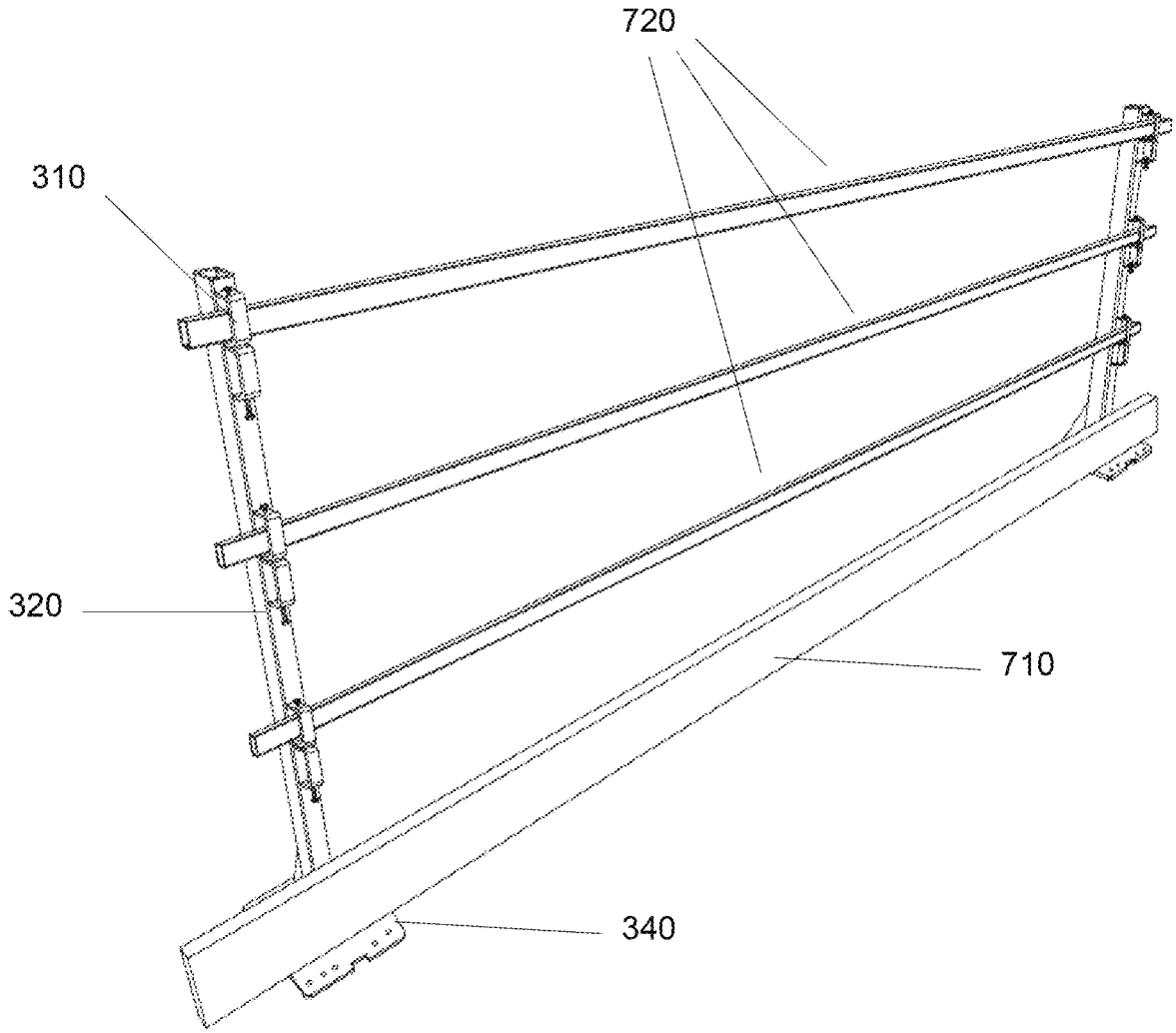
FIG. 7 is a side perspective view of another example safety rail post and system according to the invention which has been set up to show its in-use configuration.

FIG. 7 is a side perspective view of another example safety rail post and system according to the invention which has been set up to show its in-use configuration with rails 720 engaged with through apertures 310 in aperture members and fixed with bolts 320. It depicts apertures 310 to receive a rail and fixing means 320 (in this embodiment a bolt or screw) to reversibly fix a rail therein and base 340. Also depicted in FIG. 7 is board 710 which functions as a kick board to stop items such as tools or fixtures or other debris from rolling along and off the edge of the floor. It also functions to provide a solid barrier for worker's feet to impact and thereby provide feedback about the proximity to the edge—for example when they are focusing their attention elsewhere, such as when carrying an item, or looking at or working on a section of the construction site. Board 710 can be fixed to posts according to the invention in any suitable manner, for example via screws into the baseplate, or a base plate support such as item 371 in FIG. 8.

Figure 8:
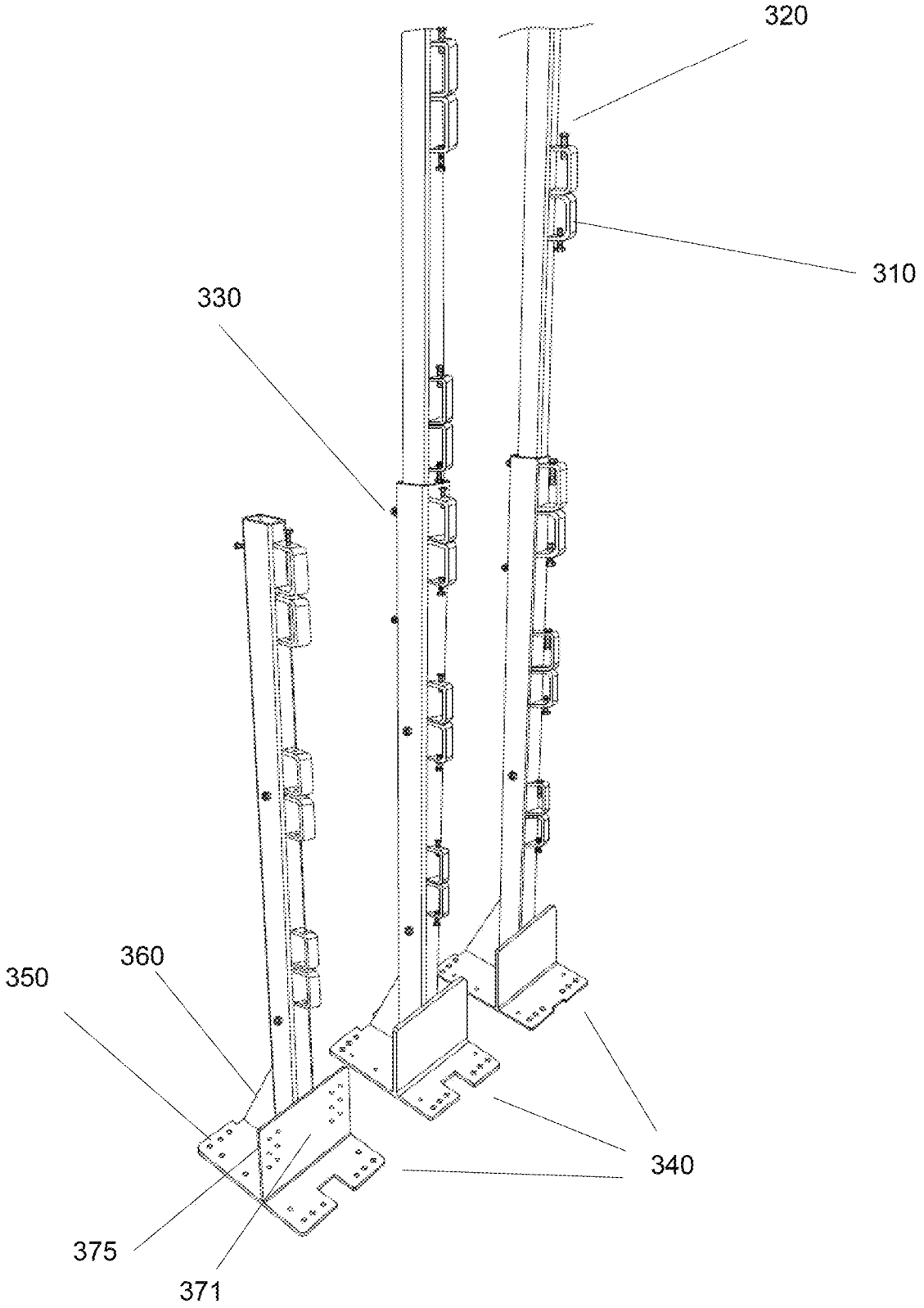
FIG. 8 depicts three safety posts according to the invention set at different heights.

FIG. 8 depicts three safety posts according to the invention set at different heights. This figure highlights the invention's flexibility in allowing handrails to be set at numerous heights. Support 371 is designed to add strength to the base and in some embodiments is used to fix a board such as a kickboard in place, for example via a bolt(s) or screw(s) engaged with one or more of holes 375.

Figure 9A:
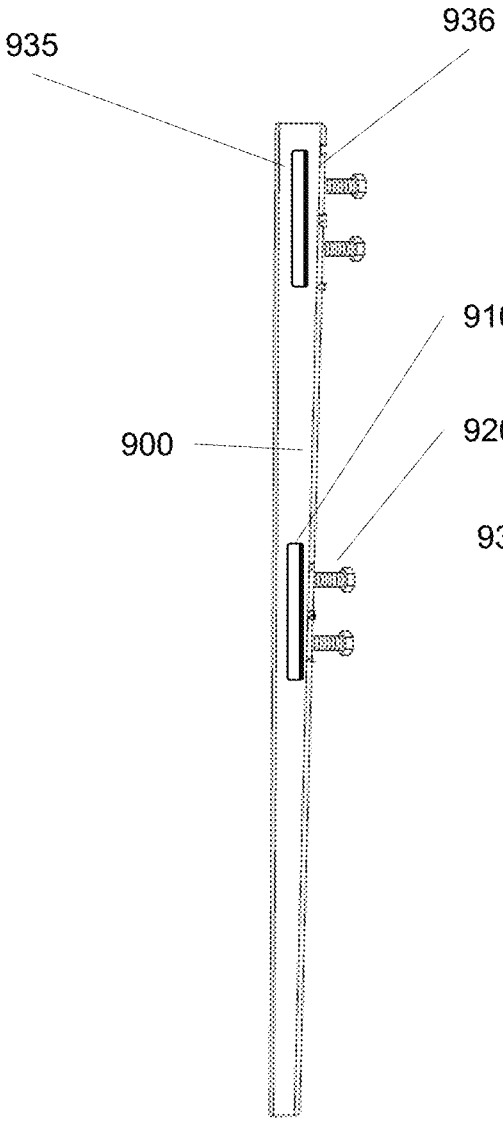
FIGS. 9*a* and 9*b* depict another embodiment of a safety post according to the invention wherein the post defines an aperture serves as rail holder.
Figure 9B:
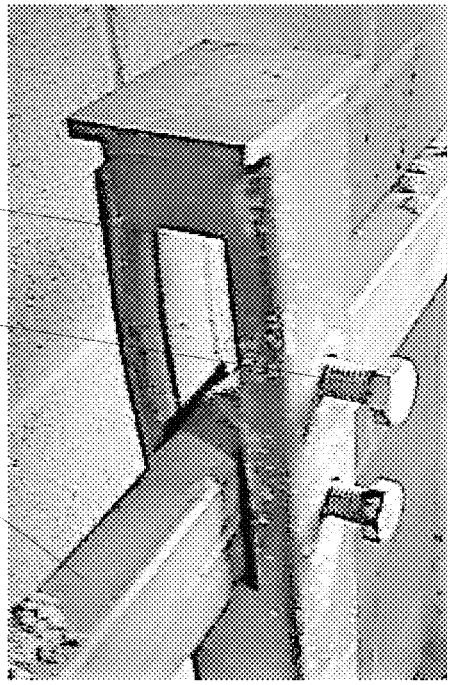

FIGS. 9*a* and 9*b* depict another embodiment of a safety post according to the invention shown generally at 900. In this embodiment, post 900 defines an aperture 910 which serves as rail holder for rail 930 which is reversibly fixed in place by bolts 920. It will appreciated that for embodiments of the invention in which the first and second components are slidable (such as a telescopic embodiment), it is preferably that only the second component (eg. upper post) comprises a rail holder according to that depicted in FIGS. 9*a* and 9*b*. This is because it is more difficult to achieve the sliding arrangement when the lower post structure is interrupted by an aperture to receive a rail. However, embodiments comprising 'split' posts that are therefore still slidable are also envisaged. Such an embodiment may for example comprise a first component (eg lower post) which defines an aperture for receiving a rail and a second component which comprises two sub posts which themselves are slidable within the two sections either side of the aperture body of the first component. Items 935 and 936 in FIG. 9*a* depict the corresponding two sections, but in this instance, in the second component, or upper post.

Figure 10A:
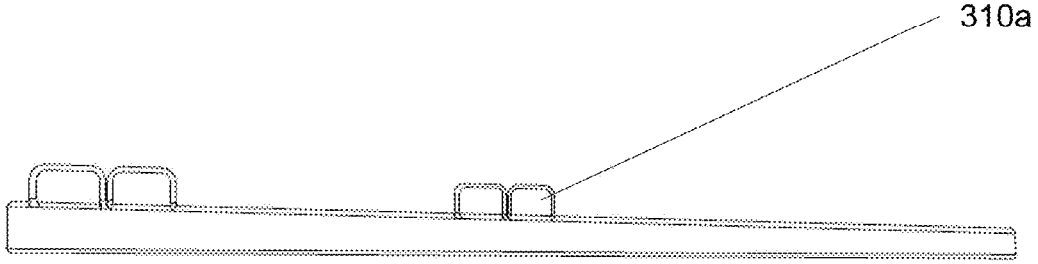
FIGS. 10*a*, 10*b*, 11 and 12 depict further example alternative posts according to the invention.
Figure 10B:
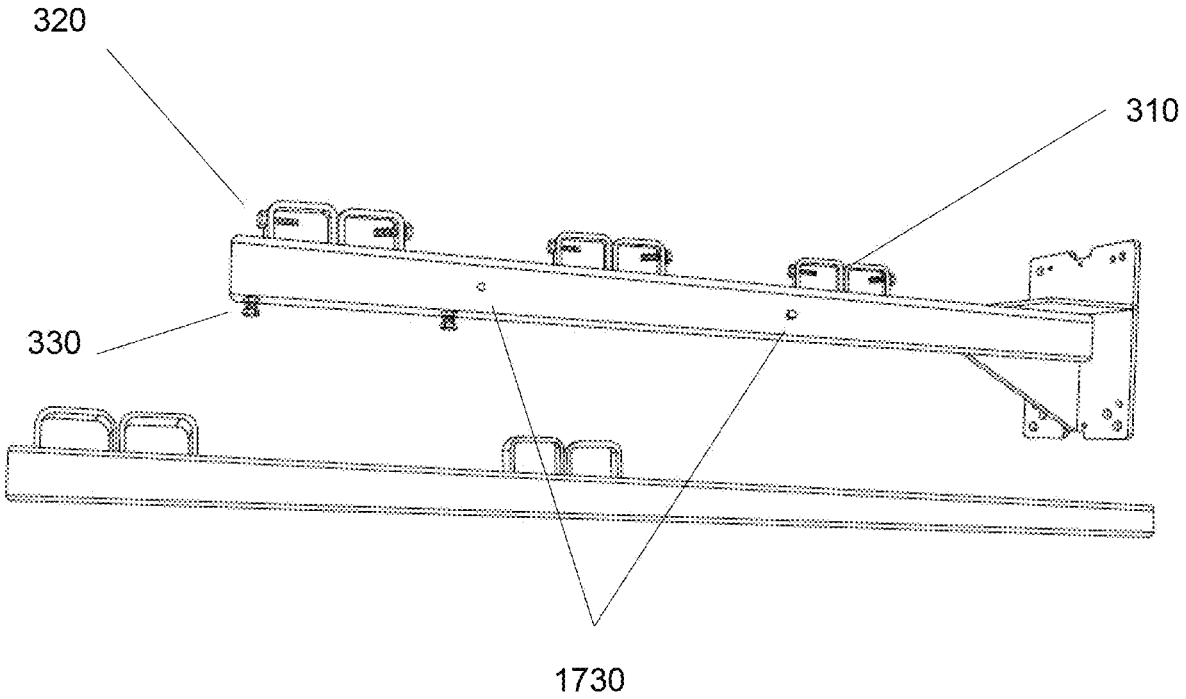
Figure 11:
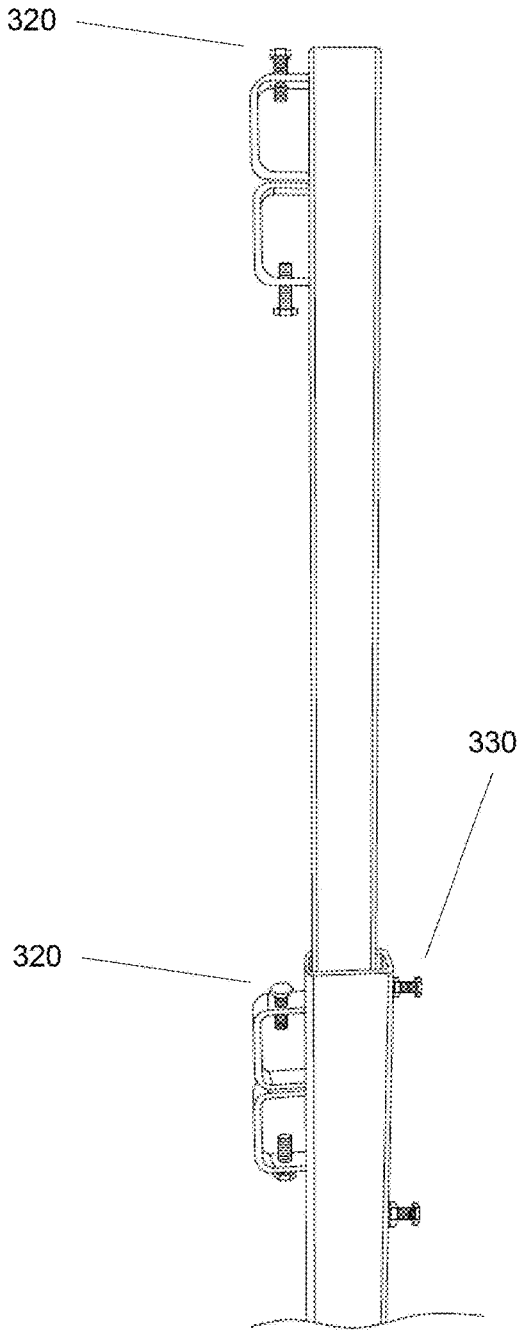

FIGS. 10*a*, 10*b*, 11 and 12 depict further example alternative posts according to the invention. Item 310*a* in FIG. 10*a* is an aperture akin to that of aperture 310 on the first component (or lower post) but placed on the second component (or upper post) and in this embodiment functions in the same way.

Figure 13:
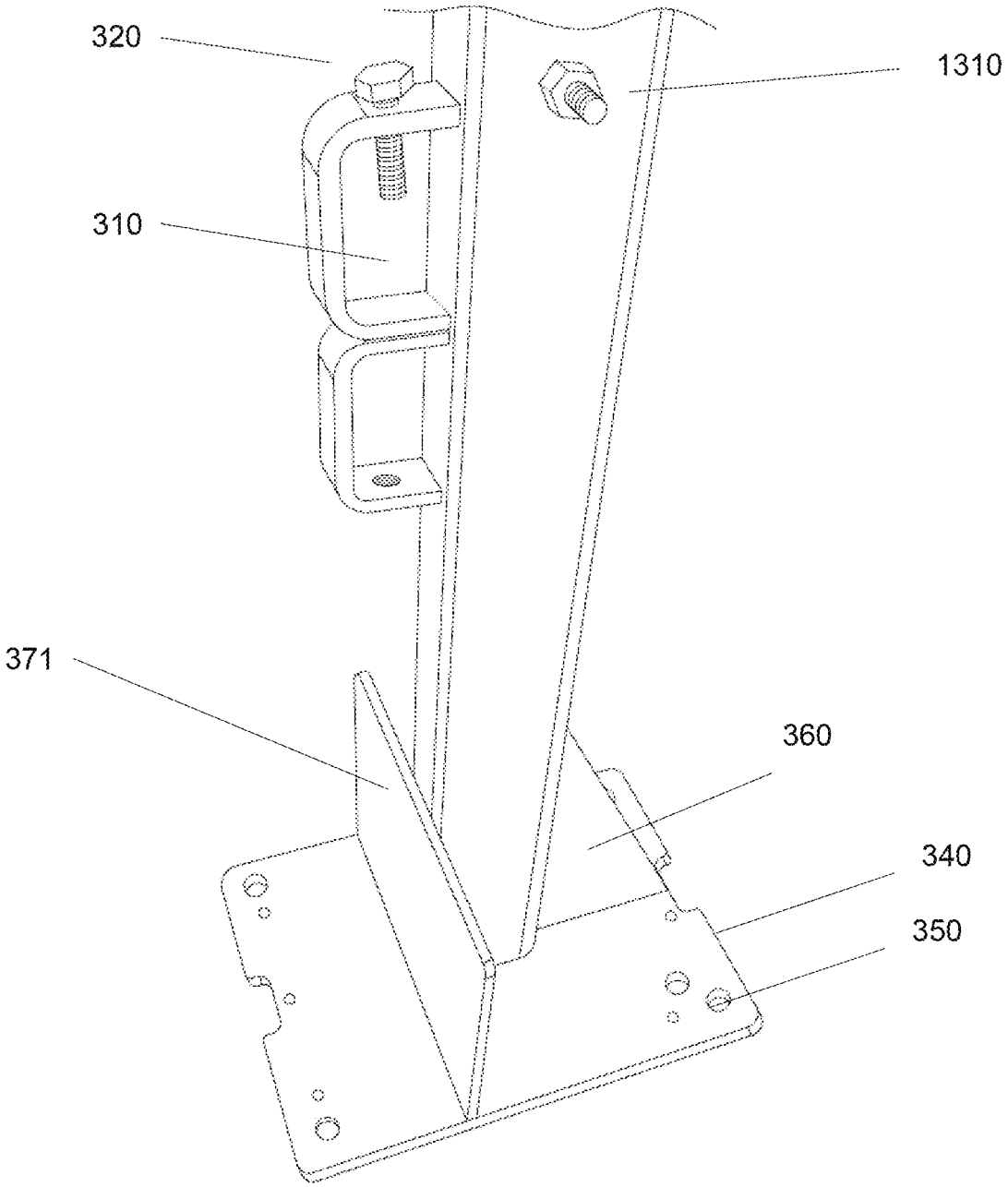
FIG. 13 is a side elevation view of an example safety post according to the invention comprising a baseplate with supports.

FIG. 13 is a side elevation view of an example safety post according to the invention comprising a baseplate with holes 350 and with supports 360 and 371 . Stop 1310 (in this embodiment, in the form of a bolt), serves two purposes. Firstly, if a worker is working at height and falls on top of the handrail system this will prevent the top post collapsing into the bottom post and potentially allowing the worker to fall over the edge. Secondly, it serves as a stop to prevent fingers being crushed when an installer is adjusting the handrail system height they will need to loosen item 330 FIG. 11. If they are not holding onto the top post item 110 it will drop into item 100 this would mean that apertures from the top post and bottom post would hit together similar to the middle post in FIG. 8. If the installer had their hand in between these two posts at that time it could easily be crushed.

Figure 12:
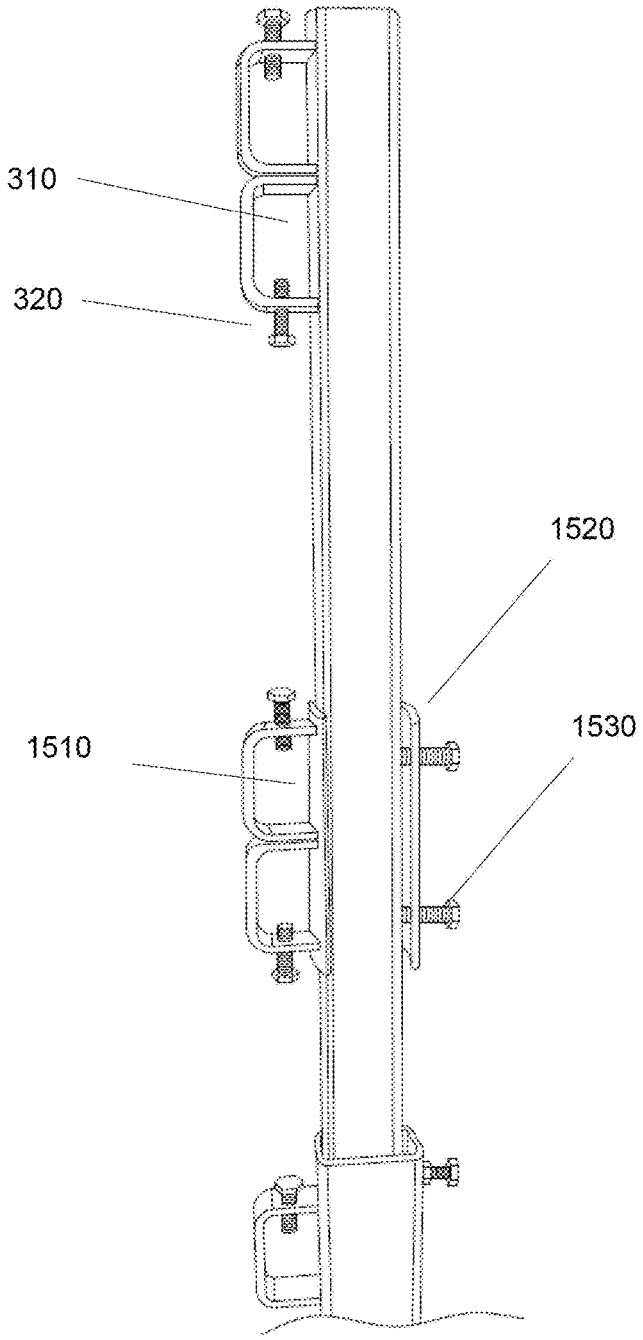
Figure 14:
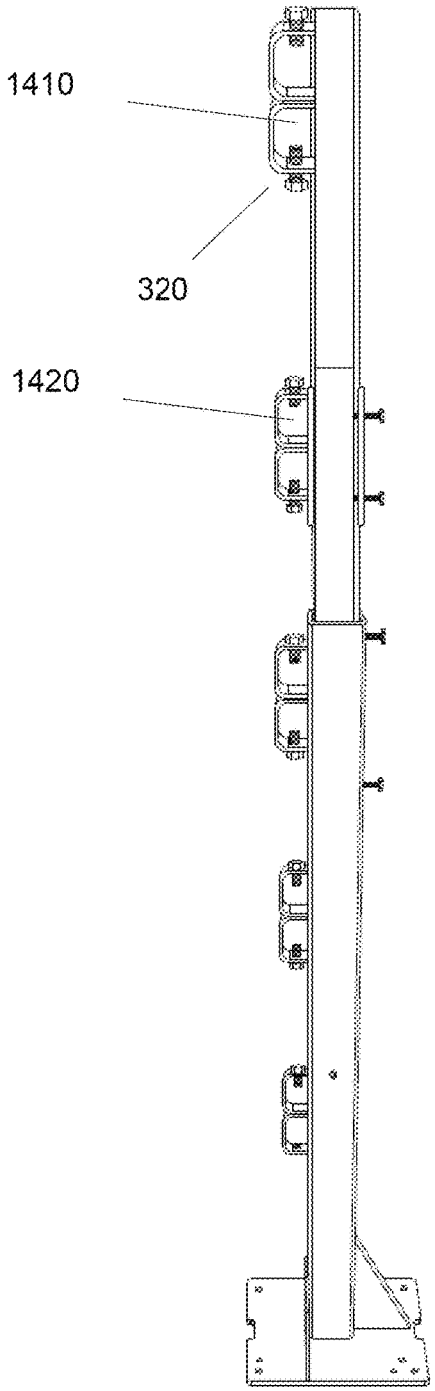
FIG. 14 is a side view of another example safety plate, also with a baseplate and support.
Figure 15:
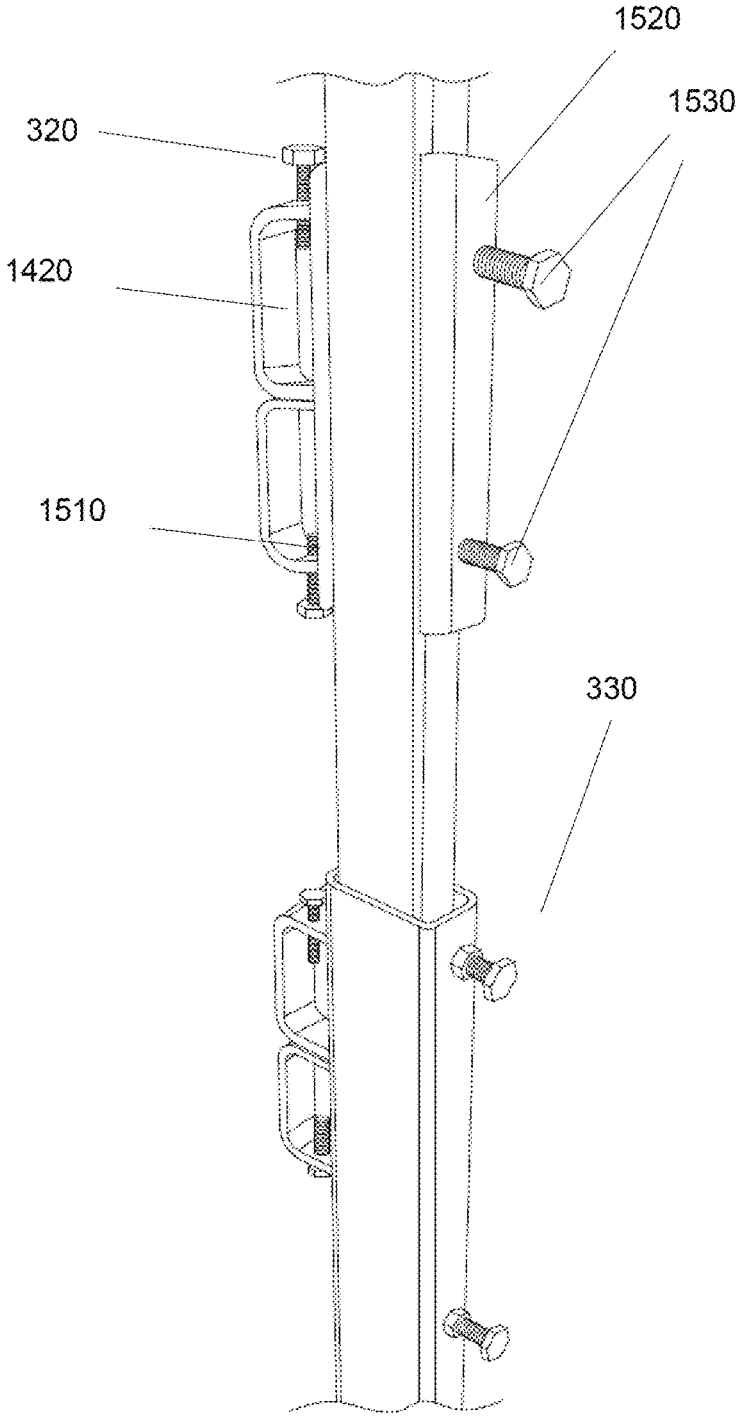
FIG. 15 is a side perspective view of another safety post and a detachable rail connector (1520) according to the invention.

FIGS. 12, 14 and 15 depict a further example safety post according to the invention with a further variation in the rail engaging mechanism. These embodiments depict an alternative extension post with only the upper rail engaging aperture members or D rings 1410 welded to the post and the lower set of D rings 1420 being configured to be detachable. Embodiments comprising such detachable aperture members provide a greater flexibility in the range of lengths that the overall, combined safety post can be set at. It will be appreciated that by detaching the lower aperture members, the upper post (or second component) can be slid to a lower position than if they were permanently fixed on. In this embodiment, detachability of the lower aperture members of the second component (or upper post) is effected by having aperture members 1420 fixed (in this embodiment, welded) to plate 1510 which is fixed in place against the second component (or upper post) with fixtures 1530 (here bolts) passing through plate 1520 into engagement with plate 1510. Other means of providing detachable aperture members might for example include using a keyhole slot and pin arrangement so that a set of aperture members with a base plate and pins can be fixed at one or more predetermined heights on the second component merely by sliding the pins of the aperture member plate into a corresponding set of slots on the second component to match the preferred height for the requirements.

Figure 16:
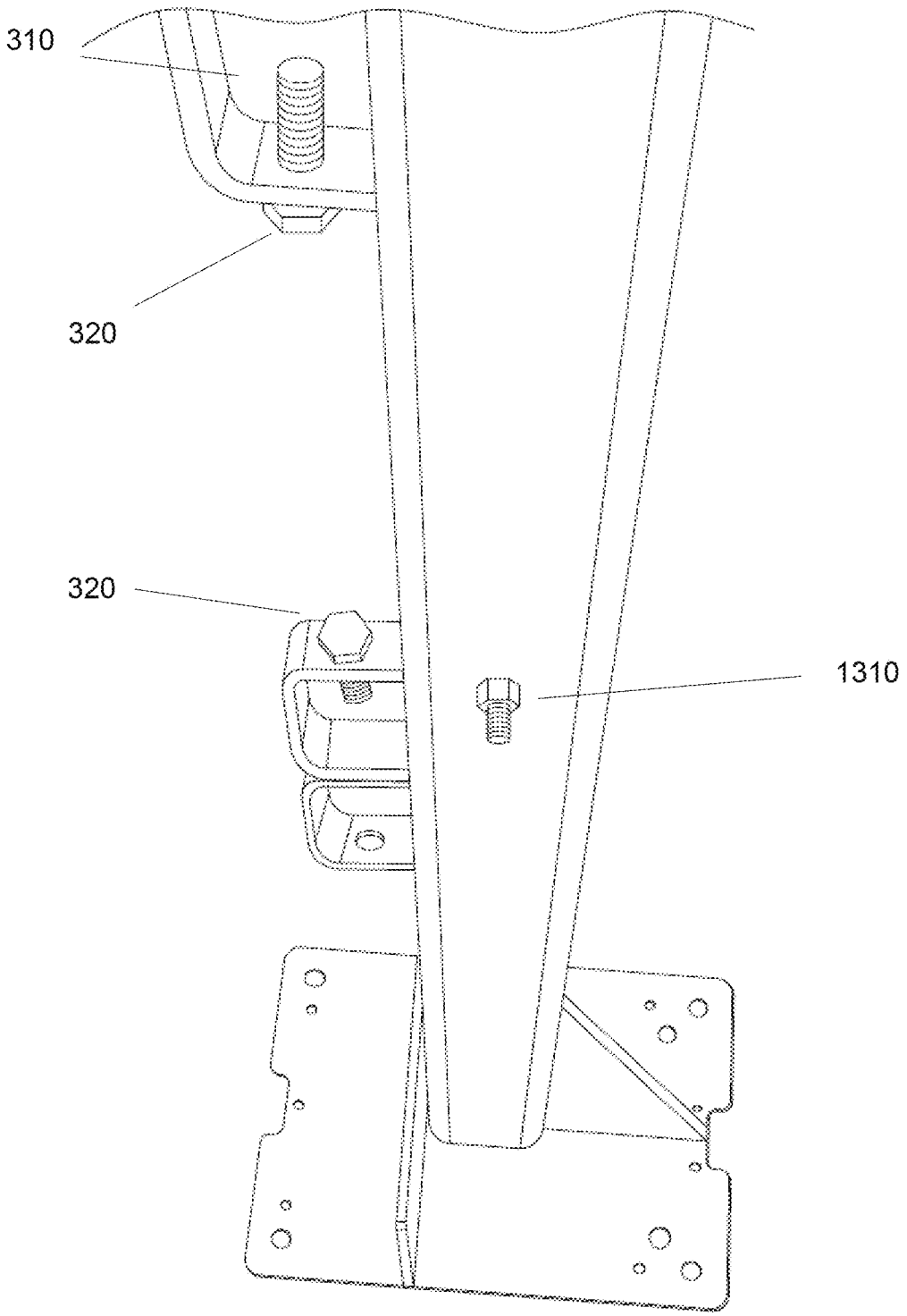
FIG. 16 is a side elevation view of an example safety post according to the invention comprising a baseplate with supports.

FIG. 16 is another side elevation view of an example safety post according to the invention comprising a baseplate with supports.

Figure 17A:
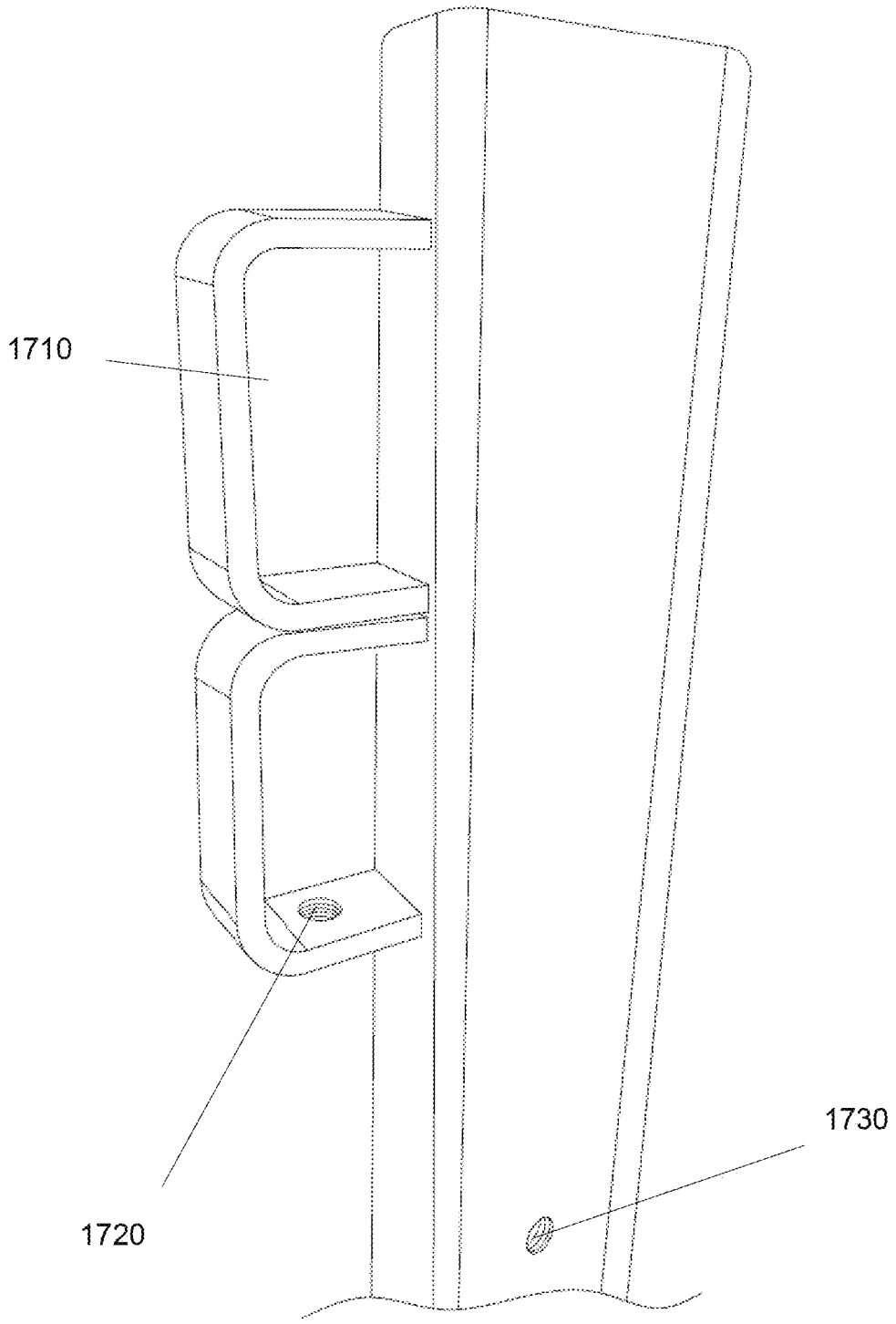
FIG. 17*a* depicts the top section of an example safety post according to the invention.

FIG. 17*a* depicts the top section of an example safety post according to the invention and shows aperture 1710 for receiving a rail to be fixed and aperture 1720 for receiving a bolt to be tightened against the rail and thereby reversibly fix it in place. Hole 1730 allows stop 1310 (in this embodiment a bolt) FIG. 16 to pass through and thereby fix the first and second components of the safety rail in place. As can be seen in FIG. 10, some embodiments comprise a plurality of such holes. In some embodiments such holes pre determine the height of the top post for example, for ease of installation. As an example, if a bolt is installed in the lower of the two holes in all posts they will all be set up at 2 m high. If the bolt is placed in the top hole all posts will be set up at 2.4 m high. This saves time as it means the installer doesn't have to measure each post as they will all be set up at the same height.

Figure 17B:
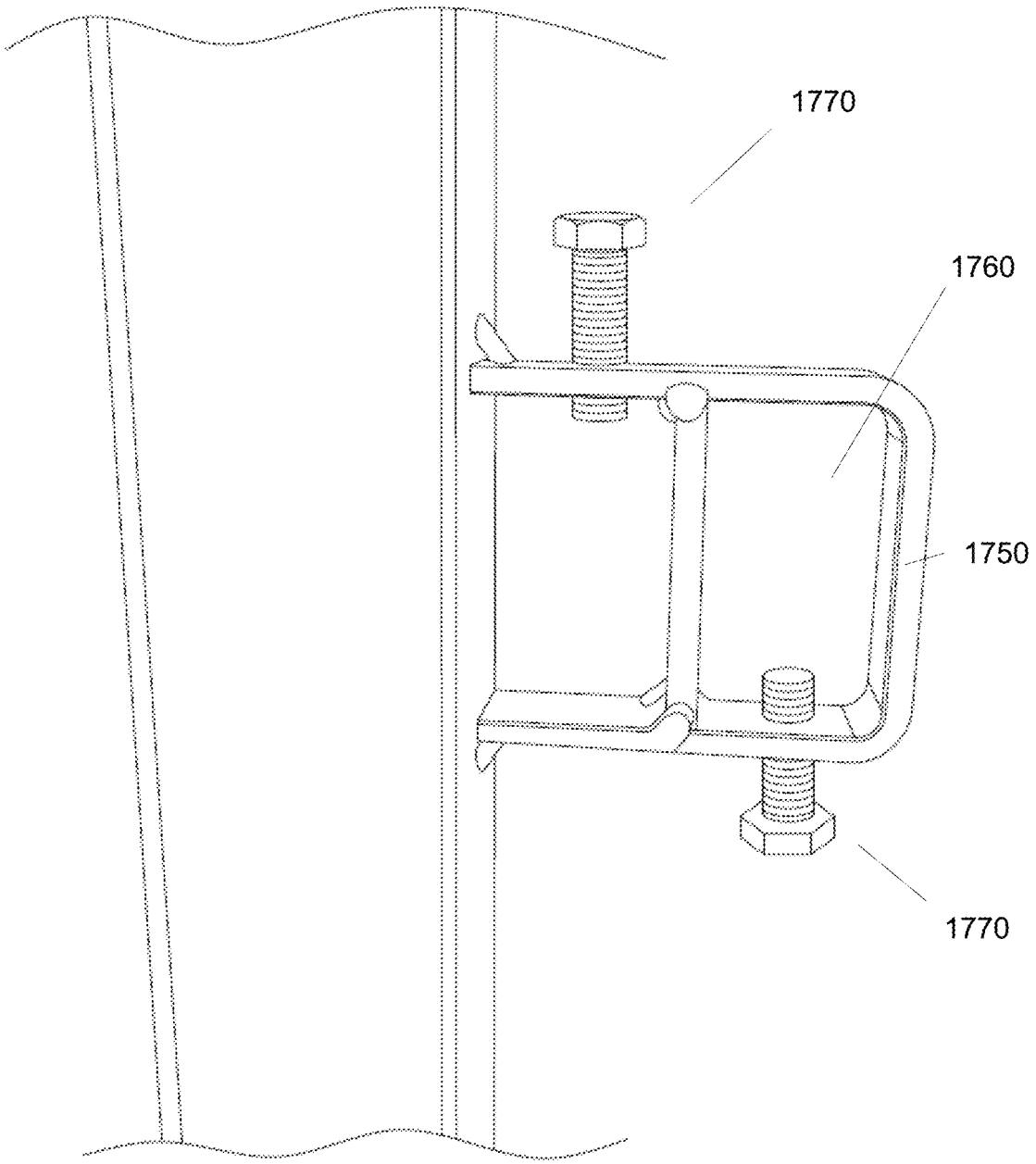
FIG. 17*b* depicts an example rail engaging mechanism according to the invention.

FIG. 17*b* depicts another example rail engaging mechanism according to the invention shown generally as 1750. The rail engaging mechanism comprises a plurality of apertures 1760, each to receive a rail which is to be reversibly fixed in place with fixing means (here bolts) 1770. In this embodiment, the aperture member defines two adjacent apertures which together are directed at right angles to the axis of the post. In this embodiment, the rails extending to each adjacent post overlap in the horizontal plane, one behind the other. This is in contrast to the embodiment of FIG. 1 in which they are placed one above the other. The arrangement of FIG. 17*b* maximises the gap between the rails allowing workers to work through the handrail system without closer rails hindering their progress.

EXAMPLE 1

Example Method of Installation

Figure 18A:
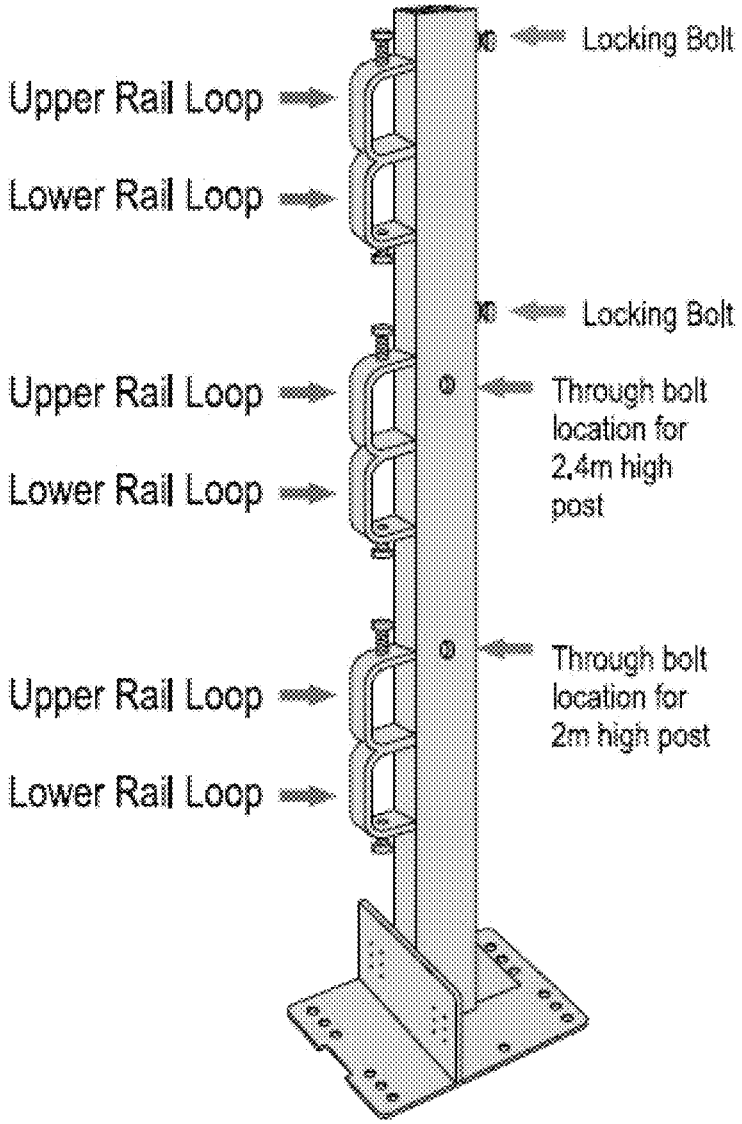
FIGS. 18*a*-18*o* depict an example installation method for a safety rail apparatus according to the invention.
Figure 18B:
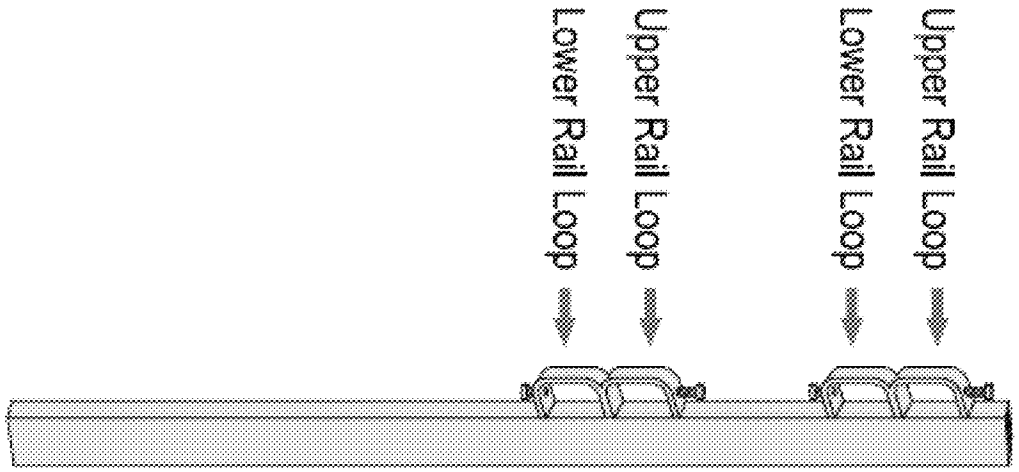
Figure 18C:
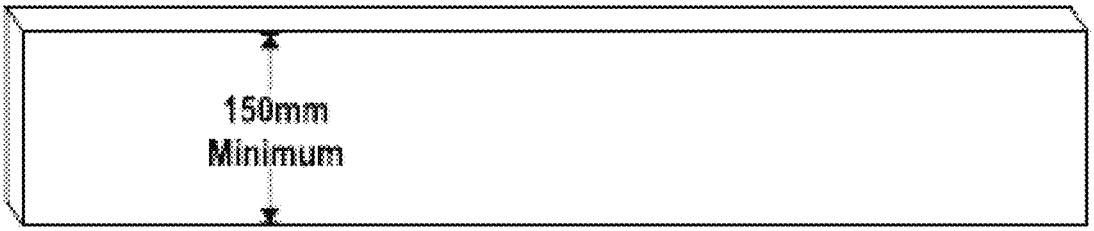
Figure 18D:
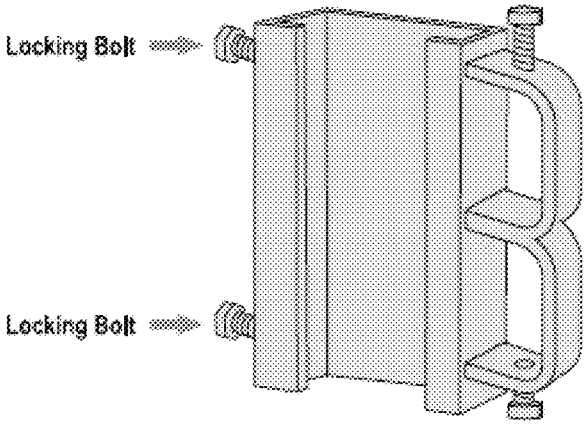
Figure 18E:
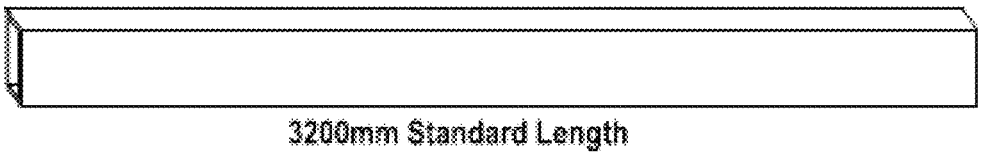
Figure 18F:
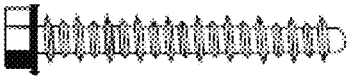
Figure 18G:
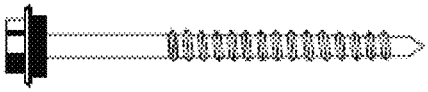
Figure 18G:
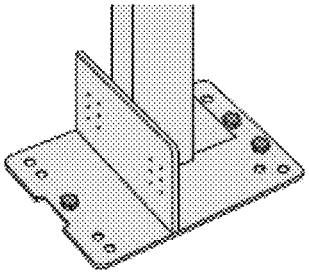
Figure 18H:
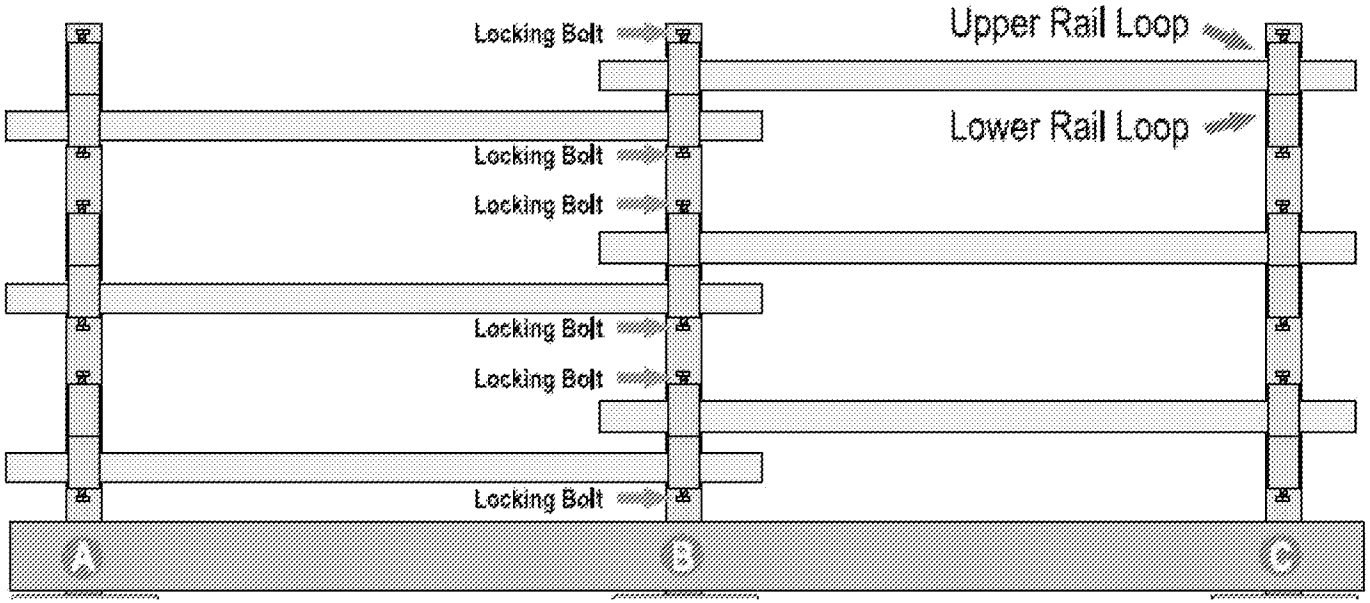
Figure 18I:
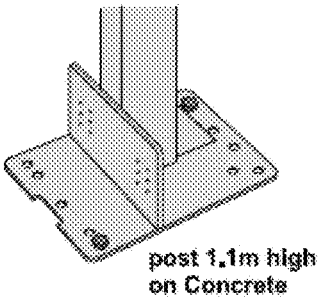
Figure 18J:
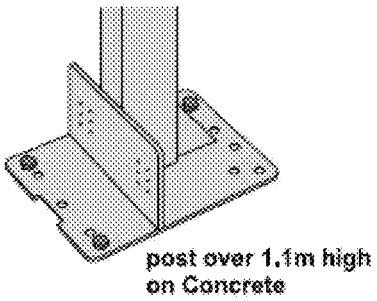
Figure 18K:
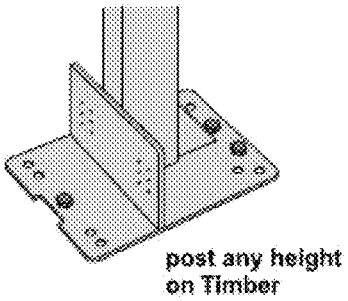
Figure 18L:
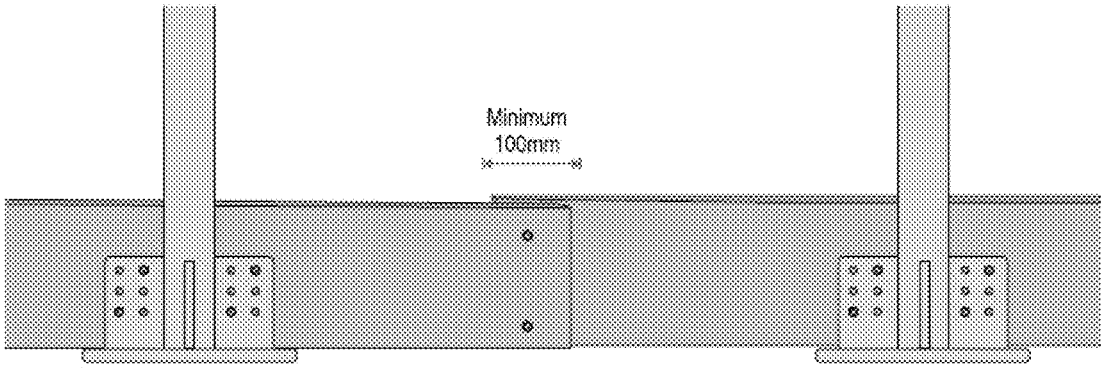
Figure 18M:
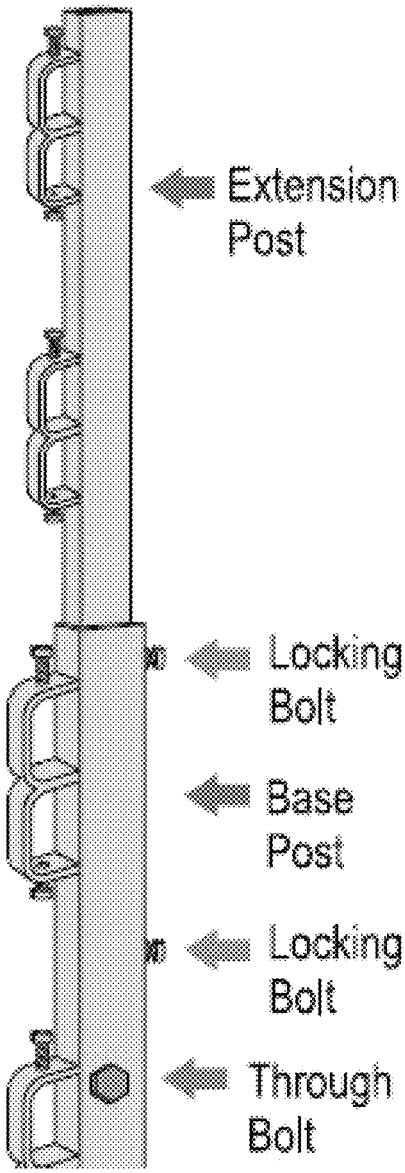
Figure 18N:
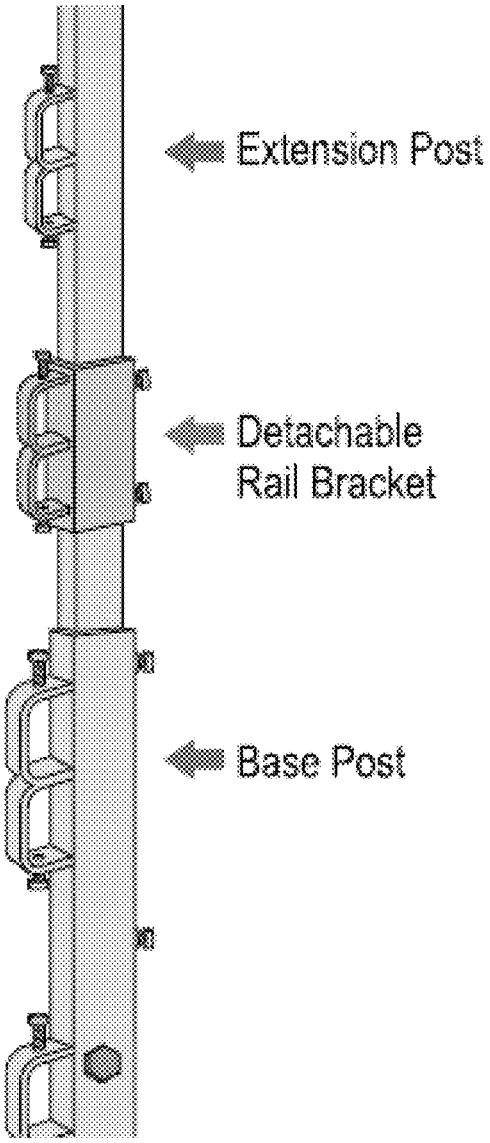
Figure 18O:
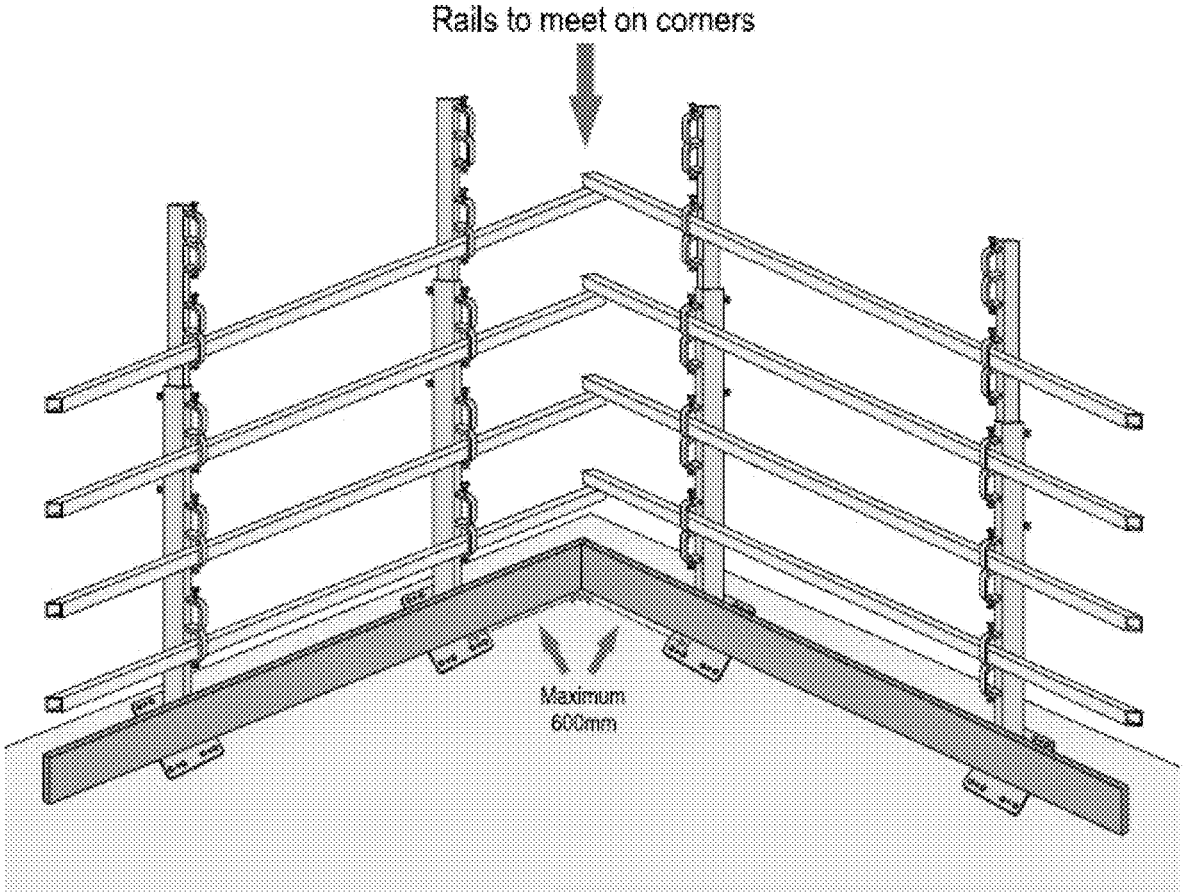

FIGS. 18*a*-18*o* depict an example installation method for a safety rail apparatus according to the invention. Guidelines for installation of an apparatus according to the invention include:

- Posts are to be installed at a maximum of 3000 mm.
- Handrail heights are dictated by the relevant Standard and are dependent on the structure pitch.
- Where midrails are used, the nominal clear distance between rails shall not exceed 450 mm.
- The nominal clear distance between a midrail and a toe board or bottom rail shall not exceed 275 mm. In any section of edge protection, the rails shall be nominally parallel.
- It is important that the structure to which the temporary edge protection is to be attached can support the forces that may be applied when the edge protection restrains a person from falling from the edge.

FIG. 18*a* depicts an example base post of 1100 mm length. It is used as perimeter edge protection on concrete slabs or timber form work. FIG. 18*b* depicts an example extension post which is used to extend the base post from 110 anywhere up to 2400 mm. FIG. 18*c* depicts an example kickboard which in this example is 150 mm high. FIG. 18*d* depicts an example detachable rail bracket which is used as an additional rail holder when the extension post is extended above 2000 mm. FIG. 18*e* depicts an example handrail which can be a variety of sizes. In this example it is 3200 mm length. Cross-sectionally it may for example be 50 mm×25 mm×2 mm or for example 38 mm×25 mm×2 mm. FIG. 18*f* depicts an M8 screw bolt for fixing the base into concrete. FIG. 18*g* depicts a 14 gauge timber screw for fixing the base plate into timber. Preferably at least 3 are used per post and preferably they are 14 mm×90 mm type 17 screws and extend into the support beams below the floor. FIG. 18*h* depicts an example safety rail apparatus according after installation.

Referring to FIG. 18*h*, position the first base post A (Part 1) into the desired location and fix to the underlying structure using the appropriate fixings:

- Fixture to Concrete
- For posts 1.1 m high, minimum of 2×8 mm screw bolts per post, set as depicted in FIG. 18*i;*
- For posts greater than 1.1 m high, a minimum of 3×8 mm screw bolts per post, set as depicted in FIG. 18*j;*
- Fixture to Timber
- For any height post, use a minimum of three 14x90mm timber screws per post, set as depicted in FIG. 18*k*. Timber screws must go through plywood and into the timer support beams below.

Returning to FIG. 18*h*, position the next base post, B, in the desired location—ensure that the base posts are no more than 3 m apart. Install rails, placing them consistently down the base posts in ether the top or bottom rail loop for any one segment. It is important that each rail is placed in the corresponding upper or lower rail loop. Next, lock the rails into position using the lock bolts supplied in each rail loop.

Next, position base post C in the desired location, again ensure that the base posts are no more than 3 m apart. Install rails placing them consistently down the base posts in the rail loops not used by the preceding set of rails. Repeat these steps until the entire area has the hand rail installed.

Turning to FIG. 18*l*, attach the kickboard with a minimum of 4 screws per post.

If the kick boards overlap at a point other than on the base posts there should be a minimum of 100 mm overlap with a minimum of 2 screws installed in the overlap to hold the kickboards together.

Turning now to FIG. 18*m*, for higher rails, place the extension post into the base post and lock into place using the locking bolts provided in the base post. A through bolt is provided in each base post to prevent the extension post from collapsing into the base post. This bolt must be moved to the higher location if the handrail is extended from 2 m to 2.4 m high.

Turning to FIG. 18*n*, for rails above 2 metres, place the detachable rail bracket onto the extension post. Space it evenly between the rail loops above and below. Lock it into position with the lock supplied in each bracket. The gap between rails must not exceed 450 mm.

FIG. 18*o* depicts a corner section of a safety rail apparatus according to the invention. Rails must not exceed 600 mm overhang from the post and rails must meet on corners.

The post, rail and rail engaging means of the invention may be manufactured from any suitable materials. For example steel, milled steel, aluminium, polymer, carbon-fibre, etc.

Some embodiments of the invention provide a handrail system comprising posts and rails, the rails fixed to the posts by brackets welded to the posts and the posts fixed to the supporting floor (preferably a concrete floor) by screw anchors. In some embodiments the rail and post of the invention deflects less than 101 mm under application of 600 Newton horizontal and vertical loads.

EXAMPLE 2

Example Specifications for a Safety Post and Rail System According to the Invention Member Sizes:

Posts 65×35×3 mm RHS (Rolled Hollow Section)×1100 high, with 50×25×3 mm RHS extension to give 2400 height.

Posts at 1 to 3 m centres.

Post bases 270×200×6 mm thick plate steel (PL) with fins in 4 mm plate steel

Rails: 38×25×2 mm RHS.

Materials: posts and rails grade 350. Plates 6 mm mild steel

Welding: minimum of 3 fillet welds over 75% of the perimeter between post and base, and 25% to fin plates.

Base Fasteners:

Into concrete for rails to 1100 high: 2/M8×60 Screw Bolts in diagonally opposite corners of the base plate.

Into concrete for rails up to 2400 high: 2/M8×60 Screw Bolts on the inside of the rail, and one on the outside.

Into concrete for rails up to 2400 mm high and debris mesh installed 4/m8×60 mm screw bolts two on the inside and two on the outside.

Into timber joists: 3/14G×90 Type 17 screws.

Figure 20:
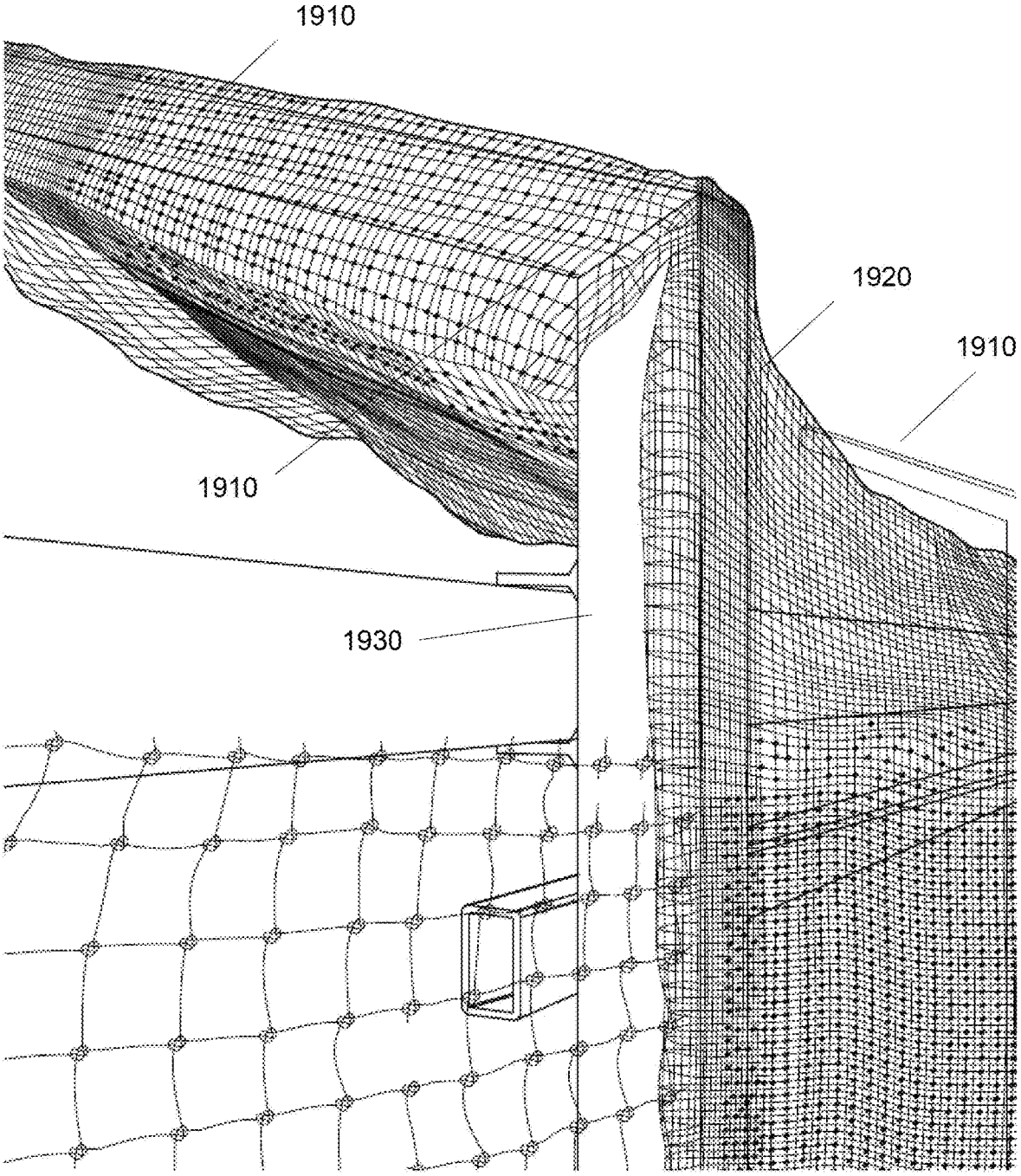
FIG. 20 depicts a side perspective view of the top end of a safety net arrangement including outrigger posts according to the invention.

FIG. 19 depicts a safety post and rail system according to the invention comprising outrigger elements and protective netting. FIG. 20 depicts a side perspective view of the top end of a safety net arrangement including outrigger elements according to the invention.

An outrigger element 1910 according to the invention is typically attached to a post 1930 which may be a safety post according to the invention, or it may be attached to a separate post which may for example be separately fixed to a post or a horizontal rail according to the invention. The outrigger elements of the invention may extend out from the building site any suitable distance. Typically such distances comprise 0.5 m to 1.5 m, preferably 0.9 m to 1.3 m, and post preferably 1 to 1.2 m. Such outrigger elements are useful to provide an additional support for further safety features such as the netting 1920 also shown in these figures. The outrigger elements may be made from any suitable materials, but typically they are made from the same materials as the rail and posts of the rail apparatus. In some preferred embodiments the outrigger elements may slidingly engage with the top of the posts and optionally be fixable in one or more positions, for example with a hole and button, or clip or slot and bolt, or other suitable mechanism. In some embodiments, the safety post of the invention itself comprises an outrigger element which may or may not be extendable therefrom.

In some embodiments an outrigger element may attach separately to a rail rather than a post. In such embodiments, the outrigger element may for example attach by means of a clamp, or bolt or clasp or any other suitable mechanism sufficient to hold the element in place and withstand forces that might be applied to it, for example if a tool or other item ,such as a bolt or a screw is dropped from an upper level and is caught by the netting. This feature adds an additional layer of safety on multi story construction sites regarding falling objects. Spacing of the outrigger elements can be discretionary, depending upon wind loadings or weight of proposed items that are intended to be prevented from falling . The outrigger elements can also be installed as required, for example only on determined sections of one elevation of a building, or alternatively could be installed continuously and on multiple levels.

Such outrigger elements add additional layer of safety to a building site by providing an additional catch nett for any minor items dropped by tradesman or blown over the side of buildings on windy days.

The mesh may be of any suitable type capable of withstanding the forces applied when items are dropped on construction sites. Preferably the mesh or netting is not too heavy which would adversely affect the primary function of the handrail system, that is to prevent people from falling from heights and comply with relevant safety standards. In some preferred embodiments, the mesh may comprise: Debris mesh 18×18×15 ply, or Unigrid 25×25 mesh.

EXAMPLE 3

Example Use of Mesh

Debris mesh must be tied to all handrails at 0.8 m centres along the rail, for example using electrical cable ties with a breaking load exceeding 18 kg each.

No ties to the posts are needed, but may be included to provide along-rail restraint.

The top of the debris mesh must be no more than 2.1 m for posts at the standard 3 m centres. If the applications requires debris mesh 2.4 m, reduce the post spacing to 2.3 m centres.

If the end of a handrail is exposed to wind from both sides, (but not where the run ends at a solid wall), add extra posts to divide the last two bays for example in half, and tie the debris mesh to handrails at 0.4 m centres.

For floors between 200 and 400 m in the city or between 100 and 300 m in the suburbs, the tie spacing should be reduced by 25% and limit the top of Debris Mesh to 1.8 m All posts should be fixed to concrete floors for example with 4×M8 anchor screws, two at the front, two at the back.

Example 4 use of mesh for city buildings to 200 m, and suburban buildings to 100 m tall.

The mesh (such as 18×18×15 ply debris mesh) must be tied to the handrail at no more than 1 m centres vertically and at 1.5 m centres along the rail. (No ties to the posts are needed.)

Where the combined height of the mesh and kick plate is no more than 1.9 m, the posts may be at the standard spacing of 3 m. For mesh extending to the full 2.4 m height of the (optional) top rail, post spacing should be reduced to 2 m.

If the end of a handrail is exposed to wind from both sides, (but not where the run ends at a solid wall), add extra posts to divide the last two bays for example in half, and tie the mesh to handrails at 0.5 m centres.

Posts should be fixed to the concrete with 4×8M Anchor Screws.

Figure 21:
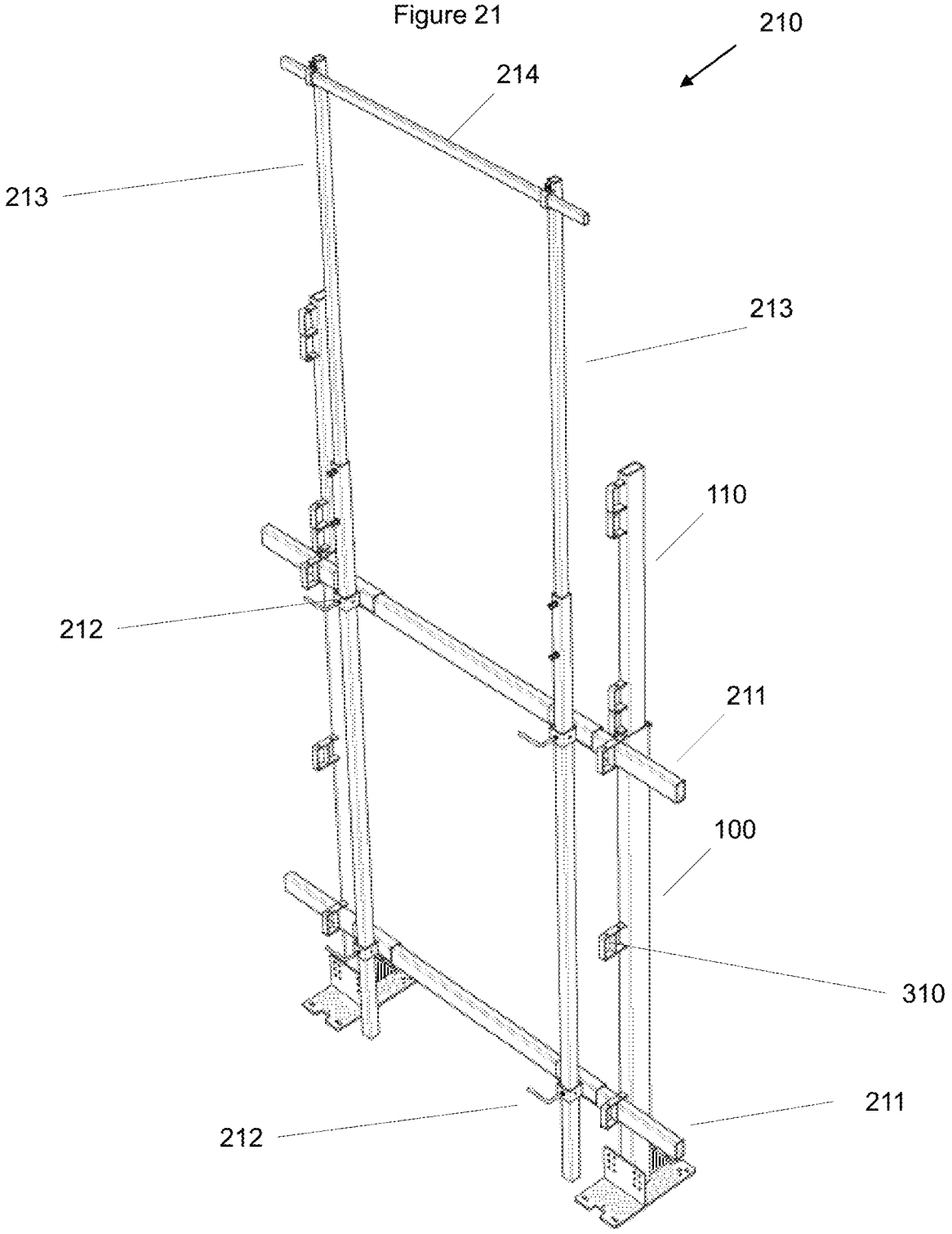
FIG. 21 depicts a side elevation view of an example extendable net support enclosure system according to the invention.
Figure 22:
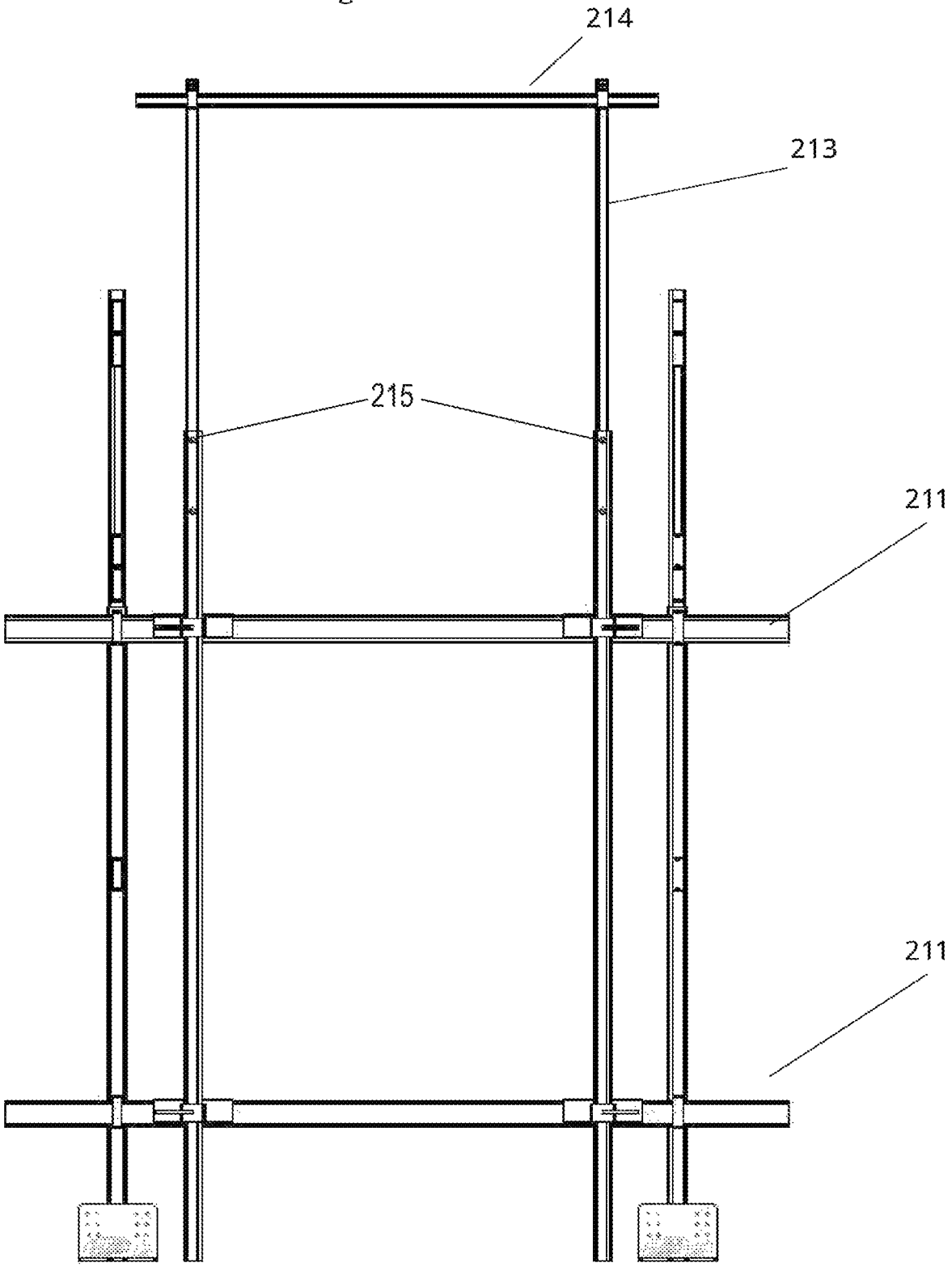
FIGS. 22 and 23 are front and rear views of the support of FIG. 21.
Figure 23:
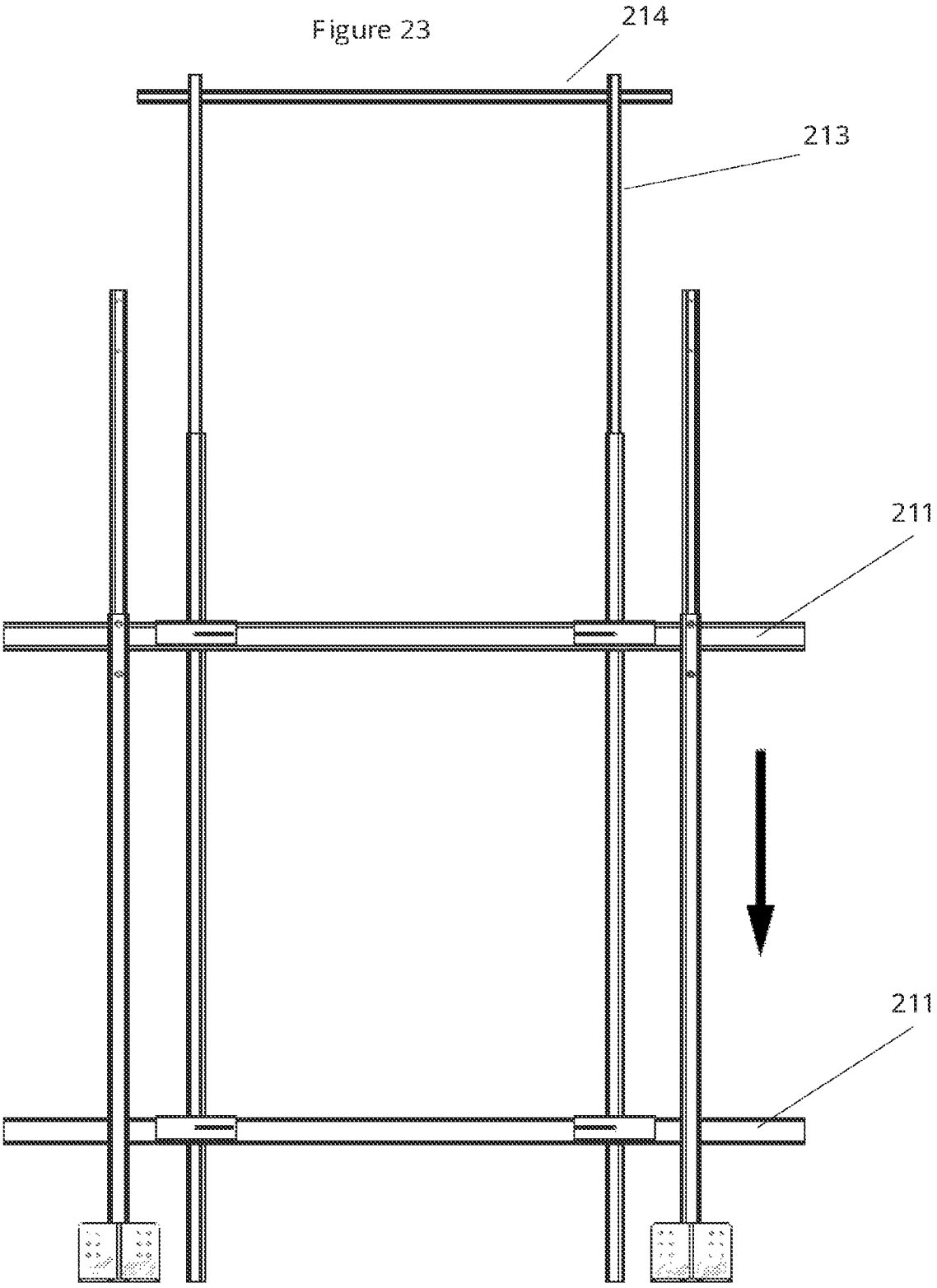
Figures 24A, 24B:
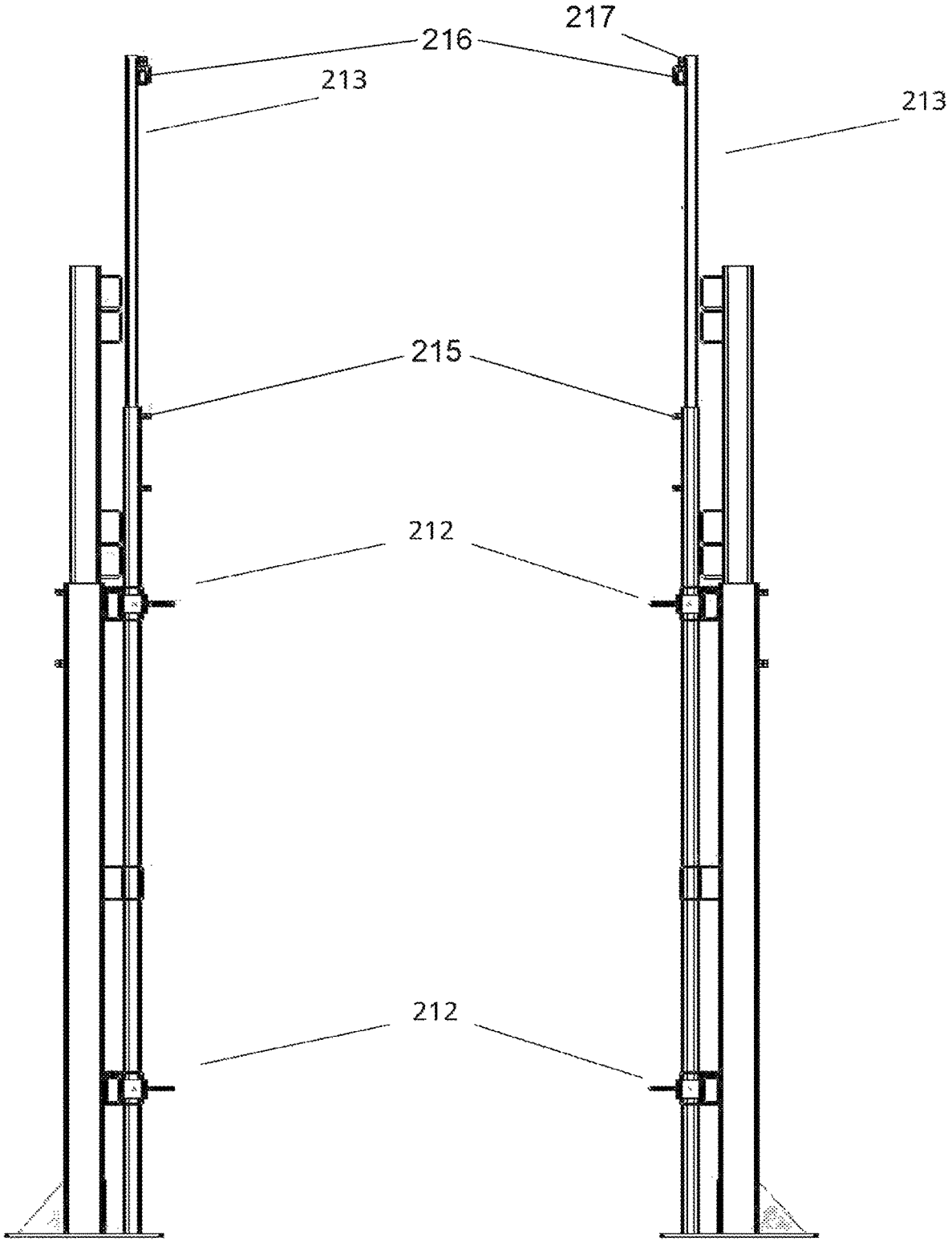
FIGS. 24*a* and 24*b* are side views of the support of FIG. 21.
Figure 25A:
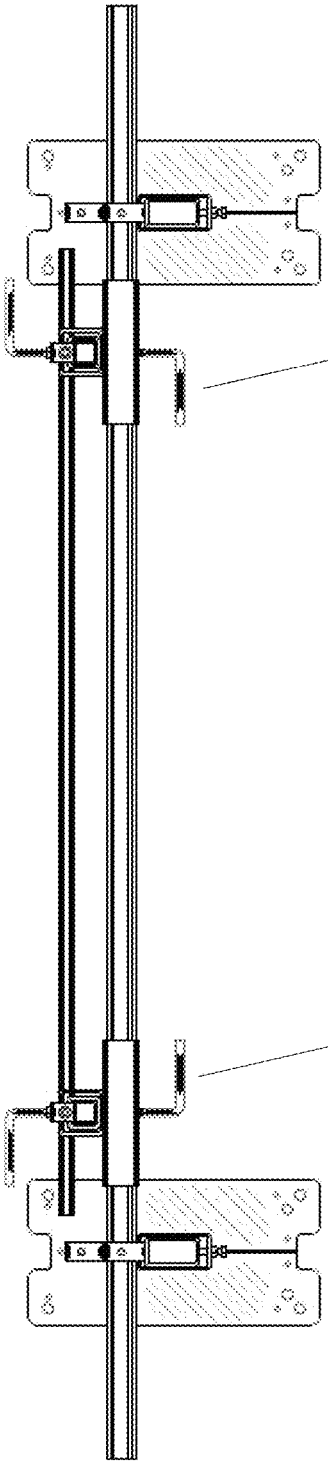
FIGS. 25*a* and 25*b* are views of the support of FIG. 21 from above and below respectively.
Figure 25B:
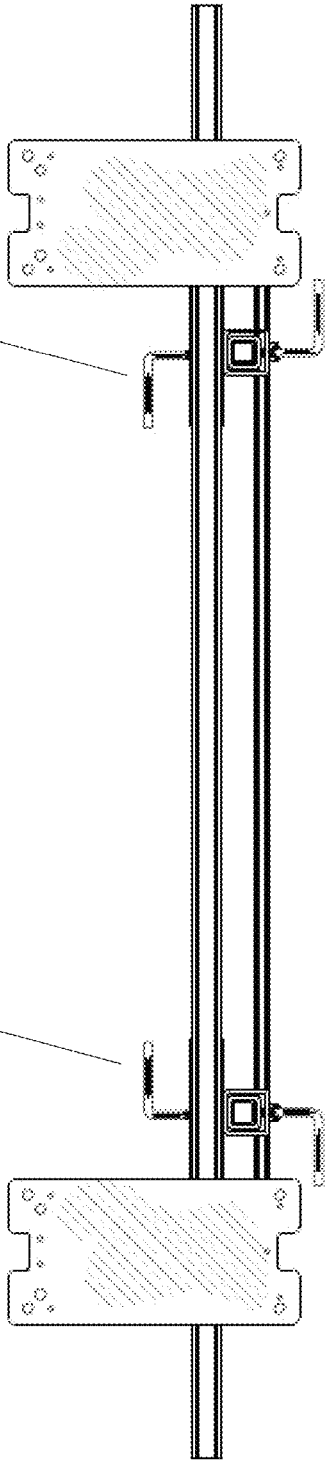

FIG. 21 depicts a side elevation view of an example extendable safety mesh support according to the invention shown generally at 210 attached to a safety rail post system according to the invention. This embodiment of the support is fixed to rails 211 by clamps 212 which in this instance are simple L shaped screw-in clamps. Support posts 213 extend vertically from the floor (and may for example be fixed to the floor) and engage the horizontal mesh rail 214 at their top. The extendable supports of this embodiment do not comprise outrigger elements but it will be appreciated that they are readily attachable to the vertical posts 213 or such posts may come with outrigger elements pre-attached. Such embodiments may comprise a further mesh rail 214 at the ends of the outrigger posts to further support or fix the mesh at its most extreme point. FIGS. 22 and 23 are front and rear views of the support of FIG. 21. FIGS. 24*a* and 24*b* are side views of the support of FIG. 21. FIGS. 25*a* and 25*b* are views of the support of FIG. 21 from above and below respectively.

In some particularly preferred embodiments of the mesh support, at least one component is slidable within or along another. In some particularly preferred embodiments, one component is concentrically slidable within another. Such slidable engagement may for example be telescopic (for example, a telescopic staunchion). In some embodiments comprising slidable operability, there is provided a winding mechanism to wind one component relative to the other between heights. Such a winding mechanism must be sufficiently robust so as to meet the strength requirements of relevant safety standards. In some embodiments, the winding mechanism uses one or more gears to enable steady movement and preferably is lockable so as to set the height of the safety rail system at a wide variety of heights.

As can be seen, in the embodiment of the invention depicted in FIGS. 21 to 25*b*, the debris mesh can be readily extended from the ground all the way up to the underside of the floor slab above. In some embodiments, mesh supports optionally attached to safety rails which are fixed to safety rail posts according to the invention are fixed at 3 metre intervals with an optional horizontal rail at the top that connects them together. The mesh can be attached to the top rail 214 for example with cable ties and then the installer can simply raise the post inner post item (213) until it hits the underside of the concrete slab or structure above. Alternatively to a top rail (214) a rope or cable could be used in lieu to support the mesh . Such an embodiment provides the building with a complete debris mesh screen preventing anything from going over the side of the building.

This is in direct contrast to current safety enclosure systems in which the debris mesh only extends to the height of the handrail system being used, or is installed from the outside of the building or requiring the installer to work at height, making installers engage in high risk works or is completely independent of the handrail system making it heavy cumbersome and costly to install. Currently if the gap in between floor slabs (for example, 3 m) is higher than the handrail system say 2 m high then there is a gap of 1 m for something to blow over the edge and fall to the ground. This is highly undesirable when constructing high rise buildings, as even relatively light items could cause devastating consequences to someone if that item fell from a significant enough height.

The mesh support apparatus of the invention provides a complete curtain wall that can be operated from the inside of the building. In some preferred embodiments, it can be fixed to a safety rail apparatus according to the invention, so that the mesh support apparatus can be produced with lighter materials which are for example cheaper and easier to handle and install, whilst receiving structural integrity from the safety rail post system of the invention. Another advantage of the mesh support apparatus of the invention is that it can be installed whilst the installer is behind the safety rail system at all times (particularly important, for example on a 20 storey building), and the installer maintains their feet on the floor slab at all times. Therefore risk from elevated work (for example on ladders, scissor lifts etc) and particularly outside the safety rail, are eliminated.

Consequently, as a result of this embodiment all work is done behind the relative safety of the handrail system, all work is also done while standing on the floor slab, not on ladders or scissor lifts, and it is cost effective.

Figure 26:
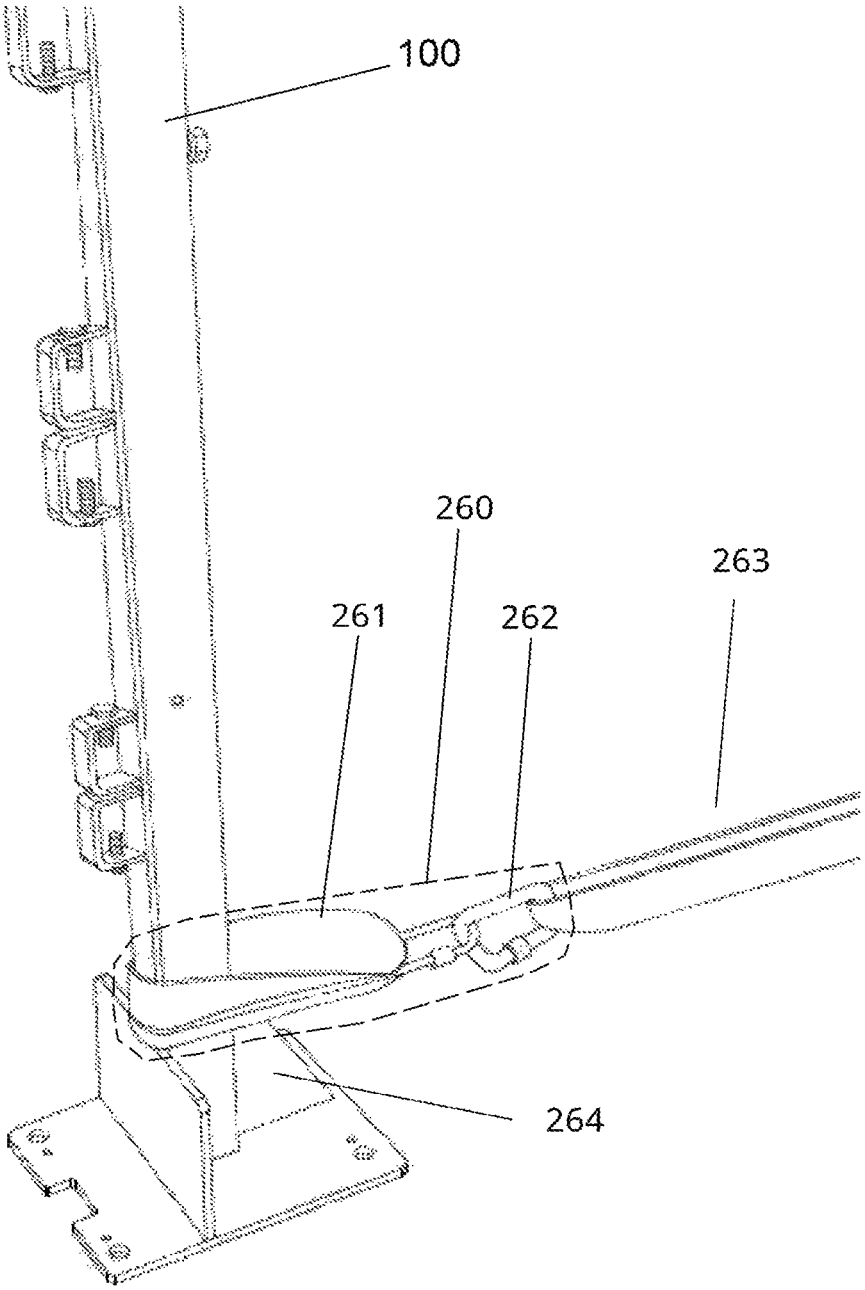
FIG. 26 depicts a safety anchor comprising a safety post according to the invention.

FIG. 26 depicts a safety anchor (such as a fall arrest anchor) comprising a safety post according to the invention shown generally at 260. The safety anchor comprises sling 261 attached via device 262 (here a carabiner) which connects safety strap, which may for example comprise or connect to a harness. In some embodiments, the anchor is designed to withstand a load of more than 12 kN (ultimate), preferably more than 13 and most preferably more than 15 kN. Some particular embodiments can withstand a 15.1 kN (ultimate) load in the direction of loading and some preferred embodiments can support a 1523 kg load.

Anchorage to the floor is an important aspect of the safety anchor implementations of the invention. Typically the floor must be at least equivalent to concrete which is 120 mm thick, preferably thicker. The bolts or screws used to fix the base of the safety post to the floor must be sufficiently strong so as to withstand the intended forces, for example at least as strong as 4×M8 AnkaScrews fixed into the concrete. Preferably the screws or bolts (such as 4 Ankascrews) should be proof-torqued during installation for example to at least 40 Nm if not specified.

In some preferred embodiments, the sling or safety device (such as a harness) is attached as close as possible to the base plate so as to maximise support. In some embodiments it is attached directly above the kick plate. However, other attachment points are possible, for example, a support member 264 may comprise an attachment means, such as an appropriately rated aperture there through.

Figure 27:
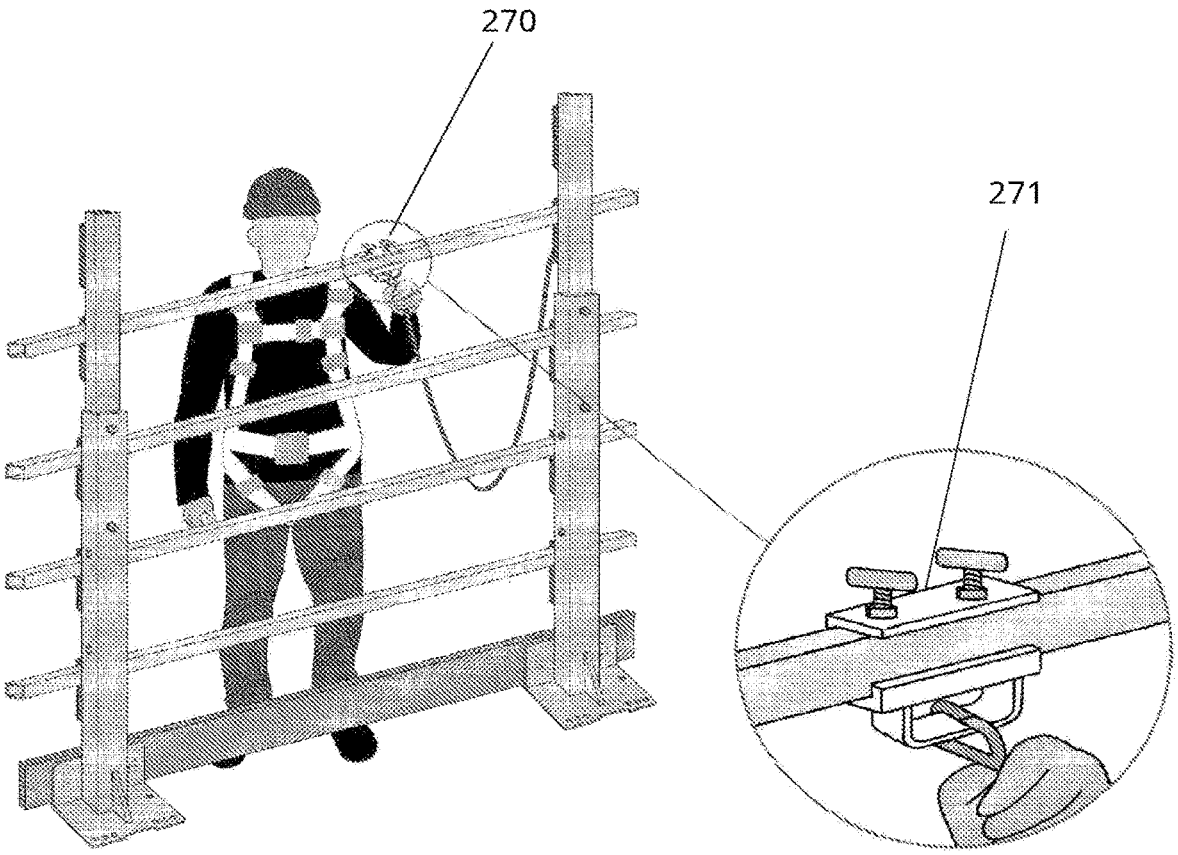
FIG. 27 depicts an example tethering system for a safety rail system according to the invention.

FIG. 27 depicts an example tethering system for a safety rail system according to the invention indicated generally by 270. Typically when the handrail is installed it is behind steel screens, for the prevention of falling objections. However there are occasions when the handrail system must be moved or altered after the screens have been removed and the external fagade of the building is not yet in place. In times such as these, falling objects are a major concern. To help prevent handrail items potentially falling to the ground, the following tethering system may be used.

1—attach a lanyard to one of the D rings on the nearest handrail post

2—attach other end of lanyard to tethering bracket 271.

3—Attach tethering bracket to approximate centre of handrail that the individual wishes to remove or alter. The tethering bracket must be fastened tightly to the rail.

4—once the proposed rail is attached firmly to the tethering bracket, loosen the holding screws in the handrail post and alter/remove as required.

5—repeat process until required task is complete.

What is claimed is:

1. A safety rail apparatus, comprising:

a post for a temporary safety rail system, the post comprising:

a base for reversible engagement with a floor, the base providing support for at least 12 kN load;

a plurality of components which are together operable to telescopically adjust a height of the post such that the height of the post is between a lower height and an upper height, the lower height ranging from 900 mm to 1.2 m and the upper height ranging from 1.9 m to 2.5 m, wherein the plurality of components is further together operable to telescopically adjust the height of the post to the lower height during one stage of a construction project and to the upper height during another stage of the construction project such that the upper height is at least 1.8 times higher than the lower height, and wherein the plurality of components comprises a lower component and an upper component, the upper component having a lower end and an upper end;

at least one rail holder configured to hold a rail in reversibly fixed engagement with the post, each of the at least one rail holder being at or substantially adjacent to the upper end of the upper component;

a stop configured to restrict downward movement of the upper component relative to the lower component; a locking mechanism configured to reversibly fix the plurality of components at the adjusted height of the post; and the rail for engagement with the at least one rail holder;

wherein the apparatus further comprises a mesh support which is configured to reversibly engage with the rail and comprises:

a first mesh support component and a second mesh support component which are together operable to adjust a height of the mesh support;

at least one first clamp configured to reversibly fix the mesh support at the adjusted height of the mesh support;

a horizontal mesh rail for supporting a mesh; and a mesh rail cross configured to hold the horizontal mesh rail in reversibly fixed engagement with the mesh support, wherein the mesh rail holder defines an aperture to receive the horizontal mesh rail and at least one second clamp to reversibly fix the horizontal mesh rail in secure engagement with the mesh support.

2. The apparatus according to claim 1, wherein each of the at least one rail holder comprises an aperture to receive the rail and a clamp to reversibly fix the rail in secure engagement with the post.

3. The apparatus according to claim 1, wherein the upper height is 2.0 m.

4. The apparatus according to claim 1, wherein the upper height is 2.1 m.

5. The apparatus according to claim 1, wherein the upper height is 2.2 m.

6. The safety rail apparatus according to claim 1, wherein the first mesh support component and the second mesh support components are concentrically slidable about one another to adjust the height of the mesh support.

7. The safety rail apparatus according to claim 1, wherein the mesh support comprises an outrigger element.

* * * * *